US007690228B2

(12) United States Patent
Hedegaard

(10) Patent No.: US 7,690,228 B2
(45) Date of Patent: Apr. 6, 2010

(54) METHOD AND SYSTEM FOR DRYING OUT THE LEATHER SIDE OF A PELT STRETCHED OUT AND FIXED IN THIS POSITION ON A PELT BOARD

(75) Inventor: Jens Hedegaard, Holstebro (DK)

(73) Assignee: Dansk Mink Papir ApS, Holstebro (DK)

( * ) Notice: Subject to any disclaimer, the term of this patent is extended or adjusted under 35 U.S.C. 154(b) by 964 days.

(21) Appl. No.: 10/572,354

(22) PCT Filed: Sep. 16, 2004

(86) PCT No.: PCT/DK2004/000619

§ 371 (c)(1),
(2), (4) Date: Mar. 16, 2006

(87) PCT Pub. No.: WO2005/026394

PCT Pub. Date: Mar. 24, 2005

(65) Prior Publication Data

US 2007/0061979 A1 Mar. 22, 2007

(30) Foreign Application Priority Data

Sep. 16, 2003 (DK) ..... 2003 01339

(51) Int. Cl.
*C14B 1/26* (2006.01)

(52) U.S. Cl. ..... 69/19.1

(58) Field of Classification Search ..... 69/19, 69/19.1, 22

See application file for complete search history.

(56) References Cited

U.S. PATENT DOCUMENTS

| | | | | |
|---|---|---|---|---|
| 1,866,709 | A * | 7/1932 | Horsting | 69/19.2 |
| 3,137,963 | A * | 6/1964 | Hein | 69/19.2 |
| 3,313,038 | A * | 4/1967 | Bolz | 34/103 |
| 4,389,795 | A * | 6/1983 | Craggs et al. | 34/103 |
| 2003/0019255 | A1 * | 1/2003 | Hedegaard | 69/22 |

* cited by examiner

*Primary Examiner*—Shaun R Hurley
(74) *Attorney, Agent, or Firm*—David S. Safran; Roberts Mlotkowski Safran & Cole, P.C.

(57) ABSTRACT

A method, a system and a pelt board for the drying of the leather side of pelts from furred animals, in which the pelt board is a hollow distension element, the surface of which has an open structure. The leather side is dried by changing the air within the distension element. The distension element is lockable in a position in which it has a first circumference, and can also assume a position or be force controlled to a position in which it has a circumference which is smaller than the first, which results in a considerably easier removal of the pelt from the pelt board. A quicker, more uniform and more effective drying of the pelts is achieved, so that "black spots" on the leather side are avoided, and the pelt is fixed in its stretched position on the pelt board without the use of clips/staples.

35 Claims, 21 Drawing Sheets

METHOD AND SYSTEM FOR DRYING OUT THE LEATHER SIDE OF A PELT STRETCHED OUT AND FIXED IN THIS POSITION ON A PELT BOARD

BACKGROUND OF THE INVENTION

1. Field of the Invention

The present invention relates to a method for the drying of the leather side of a furred animal pelt which is stretched out and fixed in this position on a pelt board, and a system for the execution of the method.

2. Description of Related Art

The invention further relates to a distension element/pelt board which can be used with the system, and which in the following will for practical reasons be randomly referred to as a pelt board or distension element, where said pelt board has a longitudinal axis, a first transverse axis (breadth axis) and a second transverse axis (height axis), and front end for receiving the cranium end of the pelt, and a foot end which terminates preferably at right-angles in relation to the longitudinal axis of the pelt board.

The invention also relates to a drying unit for use together with the pelt board.

In the drying of pelts, for example a mink or a fox pelt (in the following referred to jointly as a pelt), after skinning and scraping off the layer of fat on the leather side of the pelt, the pelts are stretched for example on a pelt board which is often first provided with a fat-absorbing material with the object that the remaining fat on the leather side of the pelt will be drawn into the paper and hereby removed from the pelt.

The use of pelt boards in connection with the drying of pelts is thus well-known, and with the passing of time there has been developed a great number of configurations of such pelt boards with the view of improving the drying of pelts.

With the mechanisation and organising of production and sale of pelts which has taken place, there has also occurred a certain standardisation of pelt sizes, and herewith also of the pelt boards on which the pelts are stretched and fixed in this position during the drying, the object being to be able to achieve the best possible and uniform pelt quality, which means that the producers can obtain a higher price for the pelts.

Those pelt boards which have become most widespread, and which today are used by the majority of the producers of pelts, including namely mink pelts, are made of wood, and can briefly be described as a flat piece of wood with a first broadside surface and a second broadside surface, and a first narrow side surface and a second narrow side surface, the breadth of which is essentially considerably less than the breadth of the broad side surface, and where the one end of the board (the foot end) is cut off at right-angles to the longitudinal axis of the board, and the lower end nearest the foot end has constant breadth, but hereafter this breadth gradually decreases towards a pointed but rounded end part (the front end, the nose end), and where the pelt board has a through-going slot between the first broadside surface and the second broadside surface, said slot lying symmetrically around the longitudinal axis of the board and extending between near the pointed end part and at least for over a half of the length of the board.

The pelt board described above is a pelt board intended for the pelts from male animals, which are normally larger than the pelts from female animals. A pelt board intended for use in the drying of the leather side of pelts from female animals does not comprise a lower end where the breath of the board is constant.

The following are some definitions which are intended to apply throughout the disclosure and claims:

The mounting of pelts is to be understood as a procedure which consists of the drawing of a pelt over a pelt board, preferably with the leather side of the pelt facing towards the surface of the board, the stretching of the pelt on the pelt board and the fastening/securing of the pelt in the stretched position on the pelt board.

The removal of the pelt from the pelt board, typically after the conclusion of the drying process, is to be understood as the removal of a pelt which has been stretched and fixed in this position on the board during the drying process. The procedure for removal also includes the removal of any elements which have been used for the fixing of the pelt in the stretched position on the pelt board.

In certain cases, the fat-absorbing material which is placed on the board before the drawing-on of the pelt consists of a bag made of fat-absorbing material, preferably of fat-absorbing paper with perforations, for example, in the form of a so-called "pelt bag," which will thus be lying between the pelt board and the leather side of the pelt.

The drying procedure or drying of pelts shall be understood to be a drying-out of the leather side of the pelt to a preferred extent which from experience excludes the attack on the pelt by mites. The drying process is typically effected by the blowing of dry air in the slot in the board via pipes which are introduced into the slot, where via the perforations in the walls of the pelt bag the dry air is diffused out to the leather side of the pelt and dries the pelt.

In the drawing of the pelt on to the pelt board, a stretching of the pelt is often effected mechanically in order to achieve the greatest possible length of the pelts, and herewith the highest obtainable price at the fur auction. With more modern pelt board machines, a vibrating movement is imparted to the machine used for the stretching of the pelt, preferably arranged in the longitudinal axis of the pelt board, the result being that it becomes possible to stretch the pelts to a size category which is greater than that which can normally be achieved, this technique is disclosed in International Patent Application Publication WO 0244428 A1. The stretching of pelts following the method described leads to greater demands regarding the securing of the nose end of the pelt on the pointed end of the pelt board, and it is preferred that the pelt is secured in the stretched position during the drying in a manner which is non-destructive.

The method hitherto used to maintain the pelt in the stretched position on the pelt board during the consequent drying has consisted of fastening the pelt to the board with securing means, for example by staples or clips which are inserted manually and which penetrate the pelt. Use is made of 10-14 clips per pelt, which thus leave 20-28 holes in the dried pelt.

After drying, the clips are removed and thereafter the pelt is removed from the pelt board, which is also often effected mechanically, and which as a consequence of the maximum stretching of the pelt often leaves elongated holes in the pelt from the clips, the result being that the optimum price can not be achieved for the pelts at the fur auction, in that 2-3 cm of the pelt where this is broadest is ruined.

Sometimes, the mechanical removal of the clips also gives rise to damages to the pelts. The holes from the clips thus constitute great losses for the fur farmers, and furthermore considerably reduce the possibilities of use of the pelts when these are subsequently processed.

However, from International Patent Application Publication WO0162985 there is known a method and a bag-shaped holster, which in the following is referred to as a fixing-bag, for use in the securing of pelts stretched on a pelt board during the drying process. The fixing-bag, the shape of which corresponds substantially to the shape of a pelt board comprising a fat absorbing pelt bag over which a pelt is stretched, is drawn over the board with the stretched pelt from the cranium end of the pelt, so that the side of the fixing-bag facing the fur side of the pelt is in tight contact with the fur, which results in the pelt being pressed against the board with a force which is sufficient for the pelt to remain substantially in the stretched position during the drying. A further advantage with use of the fixing-bag is that a drying of the fur side of the pelt during the drying process is avoided, whereby the normal processing of the pelts with a water-bearing rotating brush, which results in a reduction of the fur's natural fat layer, and herewith the natural silky appearance of the pelt, can be omitted.

Considerable savings are thus achieved with the use of the fixing-bag, but the use of this demands that it is very correctly placed, and despite the placing being carried out correctly, it is ascertained that the stretched pelts secured on the pelt board by the fixing-bag slip slightly on each side of the tail root of the pelt, which can be due to the fact that sufficient holding force/friction can not be established between the surface of the pelt board and the leather side of the pelt on the broadside surfaces of the board, with reduced pelt size as a consequence. To counteract this, with a view to preserving the expected pelt size category, use is thus made of two to four staples which are driven through the pelt in the mentioned areas of slip and into the pelt board, as an extra security regarding the fixing of the pelt in the stretched position by the fixing-bag. The use of said staples will result in holes in the pelt in the stapled areas, thus reducing the value of the pelts, which is undesirable. Moreover, the use of the staples damages the wood of which the pelt board is made.

The work in connection with the dismounting (removal) of pelts stretched on pelt boards after the conclusion of the drying process is time-consuming, even though machines have been developed for the cutting-up of the fixing-bags, the extraction of the staples and the drawing-free of the pelt from the pelt board.

The use of the bag of fat-absorbing material, which is drawn over the pelt board so that this is placed between the wood and the leather side of the pelt, serves to protect the wooden board against the penetration of fat from the leather side of the pelt, which extends the lifetime of the pelt board and has the advantage that the pelt is easier loosened from the pelt board during its removal.

However, a disadvantage with the use of the pelt-bag is that it prevents the through-flow of air on the leather side of the pelt during the drying process, which can result in what is known in the fur trade as "black spots", and herewith oxidisation of the leather side of the pelt. The said black spots are places on the pelt where the leather side has not been adequately dried during the drying process, and where the pelt is very exposed to attack from mites, with the result that the hairs on the fur side of the pelt become loose and can fall out, with consequently reduced possibilities of use for the pelt, which is completely undesirable. Moreover, pelts which have "black spots" can not be used in the production of fur products where the leather side of the pelt is turned outwards. It is estimated that 25% of the pelts received at the fur auctions can not be used with the leather side outwards because of insufficient drying. As a rule, said "black spots" arise in the places where the pelt is pressed against the surface of the pelt board with the greatest force, which most often will be the areas around the board's narrow sides where, as a result of the stretching of the pelt on the pelt board, the leather side of the pelt is drawn very tightly in against the board, which results in the drying in these areas being minimal. With the known pelt boards, operations are effected with two conflicting problems, namely the desire concerning the stretching of the pelts to the greatest possible size category, and the fastening of the pelt in this position during the drying without damaging the pelt, while at the same time being able to carry out an effective and uniform drying of the whole of the leather side of the pelt so that "black spots" are avoided.

Despite the improvements which have already been achieved with the use of fat absorbing pelt board bags and fixing bags for the fastening of the pelt stretched on the pelt board, there thus continues to exist a distinct need to solve the abovementioned recurring problems in connection with the drying of pelts, so that the pelts delivered to the fur auctions have a uniform quality.

SUMMARY OF THE INVENTION

The object of the present invention is thus to provide a method and a system comprising arrangements for use in the drying of pelts, the use of which in combination with the use of fixing-bags for securing the pelt stretched on the pelt board obviates any use of clips/staples for the securing or pelts on pelt boards during the drying process.

A further object of the invention is to ensure an effective drying of the pelts during the drying process, so that "black spots" do not arise on the leather side of the pelt after conclusion of the drying process.

A further aspect of the invention is to make possible a more effective and quicker manner in which to effect the removal of the dried pelt from a pelt board after the drying process has been concluded.

This object is achieved with a method for the drying out of the leather side of the pelt from furred animals, where the pelt is drawn onto and stretched on a distension element/pelt board, the walls of which define a cavity whose surface has an open structure, with the leather side facing towards the pelt board, and where the pelt is fixed in this position during the drying process by the drawing-on of a fixing-bag, which at least over a part of the lower end of the pelt, presses this against the board, and where the drying of the leather side of the pelt is effected by replacement of the air inside the cavity of the distension element/pelt board, and herewith that air which exists under the open structure.

It is thus realised that it is possible to effect the drying of the leather side of a pelt by stretching and fixing this in the stretched position by means of a fixing-bag on a distension element/pelt board, the perforated sides of which define a cavity, by implementing a continuous replacement of the air inside the cavity under the perforations. Moisture from the leather side will thus be transported away by the replacement of the air in the cavity, and there will also take place an effective drying out of that part of the leather side which lies up against non-perforated areas of the pelt board, in that the moisture from these locations on the leather side is drawn towards that place where the air is replaced, namely in the pelt board's cavity, whereby the air stemming from the parts of the pelt which lie against non-perforated areas of the pelt board will also be transported away. This means that an effective and uniform drying out of the leather sides of the pelts is achieved, which results in the elimination of "black spots."

Moreover, there is achieved a considerable reduction in the drying time for the leather side of a pelt. Trials with the method have shown that the drying time for the drying of the leather side of, for example, a mink pelt, by use of the pelt board according to the invention, can be reduced right down to approx. 22 hours, which is a considerable reduction compared with the normal drying time which lies at around 48-96 hours. This will result in the utilisation of the distension elements/pelt boards becoming more effective, with the further result that a fur manufacturer can reduce the number of distension/pelt board elements in the production.

It shall be mentioned that in U.S. Pat. No. 3,137,963, there is disclosed a distension element for use in the drying of the leather side of the pelt from a furred animal, where the element consists of V-shaped profiles which are mutually connected in the pointed end of the element by swivel connections, and which comprises means for stretching/fixing of the legs in the stretched position. The element stretches the pelt so that a cavity is formed between the sides of the pelt, with a distance corresponding to the breadth of the V-shaped profiles, where the air can be replaced during the drying process, but the element is not suitable for use in the drying of pelts which are stretched out mechanically and are desired to be fixed in this position during the drying process. Moreover, doubt can be raised concerning the expediency of using this element, since that contact surface between the V-shaped profiles and the leather side of the pelt will hardly be able to be dried effectively, a problem which the invention seeks to solve by placing an electrical heating element in the cavities of the V-shaped profiles. This aspect alone results in the distension element/pelt board being less expedient in use in connection with the production of many pelts, in that the time consumed in the connection of electricity to the heating element will double the handling work.

In U.S. Pat. No. 3,331,038 there is disclosed a pelt board consisting of a thin frame of steel wire with welded transverse braces. In the tail end of the board there is an annular bearing which is welded fast to the lowermost transverse braces, said bearing supporting a stretch-rod which extends between the bearing and is pivotally housed near the pointed end of the board. A holding mechanism is provided close to the foot of the board, this mechanism consisting of a wooden plate which is connected to the frame in a displaceable manner, and whose one side surface comprises a grid consisting of two slotted plate pieces, between which the rear paws and the tail of a pelt drawn onto the board shall be placed, after which the grid is fastened to the wooden plate with drawing pins, the pelt is hereafter stretched out by a displacement of the wooden plate, after which the stretch-rod, which consists of a flat piece of steel, is turned 90 degrees so that its broad side stands at right-angle out from the plane of the frame, whereby the pelt is stretched out so that a cavity is defined where there is possibility for a good through-flow of air during the drying procedure. Neither does this pelt board construction lend itself to the stretching of a pelt and fixing of the pelt in the stretched position without the use of penetrating fixing elements.

In U.S. Pat. No. 1,866,709 there is disclosed a pelt board which consists of a perforated distension element of sheet metal, the edges of which are bent with the view of increasing the rigidity of the board. When a pelt is drawn on to the board and stretched, a cavity is formed between the tangent points of the edges and the leather side of the pelt, in which cavity the air can be replaced during the drying procedure. Neither is this board suitable for use in the drying of the leather side of pelts, in that an effective drying of the pelt will hardly be able to be effected in the areas which are in contact with the bent side edges.

With the object of further optimising the drying process according to the invention, and to ensure that the replacement of air in the board's cavity becomes effective, the method can comprise that the replacement of the air in the hollow distension element can take place by placing one or more distension elements in a cooperating drying aggregate comprising an encapsulation which defines a cavity with first openings for the placing of at least one distension element, additional openings near the respective first openings lying within the limit of the foot ends of the respective elements, so that the additional openings stand in connection with the cavities in the respective distension elements/boards which are placed in the upwardly-facing surface, so that the air in the cavity of a distension element/board which is placed in the upwardly-facing surface is changed by the replacement of the air in the cavity by an air-replacement arrangement, such as disclosed herein.

A saving of time is hereby achieved in the handling of the distension elements after pelts have been applied until the drying process can begin, in that the distension elements are successively placed in the drying aggregate without having to manipulate with air pipes etc., as is the case with the drying procedure which is normally used.

A system for use in the drying out of the leather side of pelts from furred animals according to the method disclosed herein, and comprising a distension element/pelt board onto which a pelt is drawn, stretched out and secured during the drying with the leather side facing towards the surface of the board, is characterised in that it comprises a hollow, elongated distension element, the surface of which has an open structure, and with a front end and a foot end, where the foot end cooperates with a system comprising a drying aggregate comprising an encapsulation with a cavity connected with an air replacement arrangement, and where said encapsulation at least comprises an upwardly-facing surface with first openings which cooperate with a lower part of the foot end of the board, and additional openings, so that the air in the cavity of a distension element which is placed in the upwardly-facing surface is changed by replacement of the air in the cavity, this being effected by an air replacement arrangement as disclosed herein.

There is hereby provided an effectively working system for use in the execution of the method according to the invention. It will thus be possible to place the distension elements/pelt boards on which the pelts have been placed directly into the drying aggregate, instead of having to collect the treated pelts on a carriage and transport these to a drying room where the boards are suspended and provided with a pipe for the blowing in of air, which in itself is a time-consuming task.

A distension element pelt board for use in the execution of the method according to the invention, and which is suitable for use together with the system, can comprise a distension element/board where the drying of the pelt takes place by drying out the leather side of a pelt which has been drawn onto the board, stretched and secured in this position by a fixing bag, where the board has a longitudinal axis, a first transverse axis (breadth axis) and a second transverse axis (height axis), a front end for engagement in the cranium end of a pelt, and a foot end which is preferably terminated at right-angles in relation to the longitudinal axis of the board, which is characterised in that the element board has at least a first and a second arched surface with an open structure which defines a cavity, and where the surfaces of the board are in essence formed symmetrically around at least two of the defined axes, and where the element board comprises at least one opening to the cavity in the foot end, as disclosed herein.

There is hereby achieved a distension element/pelt board which extends in a arched manner over the "flat side", which means that the fixing-bag drawn over the board on which a pelt has been placed, stretched and held in this position, will be able to secure the pelt in this position during the whole of the drying process, simply for the reason that the pressure forces which will arise between the inside of the fixing-bag and the fur side of the pelt will be transferred as pressure forces between the leather side of the pelt and the surface of the board and, due to the arched shape of the board, a greater friction will hereby arise between the pelt and the surface of the board, and this will serve as a fastening of the pelt which will be effective over a considerably greater area compared with those frictional forces which can be brought about between the leather side of a pelt and one of the traditionally-used boards comprising two plane broad-side surfaces and two narrow-side surfaces, where the friction between the surface of the board and the leather side of the pelt is brought about mainly in the areas around the narrow-side surfaces.

The arched shape of the board's surfaces results in the leather side of the pelt being stressed more uniformly during the stretching of the pelt on the board, as compared with the stress during the stretching of the pelt on the traditionally known pelt boards. This aspect means that in the use of the pelt board according to the invention, it will be possible to stretch the pelts on the board to a greater extent than will be possible with the pelt boards traditionally used.

The above-mentioned open structure of the surface of the board shall be understood in a very broad sense. In practice, the open structure could consist of an arched grid construction which provides optimal conditions for the changing of the air in the cavity defined by the grid construction, and herewith of the air under the leather side of the pelt In a further embodiment of the pelt board, this can comprise at least a first and a second arched, holed/perforated surface which defines a cavity, and where the board is formed symmetrically around at least two of the defined axes, and where said arched surfaces comprise perforations/holes which stand in connection with the cavity, as disclosed herein.

Where effective drying conditions are concerned, the perforations in the arched surfaces have the same effective function as the above-mentioned open structure, and in combination with the fixing-bag will contribute towards a further strengthening of the fixing of the pelt, in that the leather side of the pelt which is drawn onto and stretched on the board will be pressed down into the perforations/holes upon the drawing-on of the fixing bag, and the edges of the perforations/holes will thus serve to reinforce the fixing of the pelt in the stretched position. The same effect will be able to be achieved with the open structure (e.g. a grid construction). Moreover, the pressing of the leather side of the pelt into the holes will result in the leather side to be dried being brought closer to the air flowing in the board's cavity, which will further improve the drying process. This means that in the areas where the leather side of the pelt are pressed particularly hard against the surface of the board, when use is made of the board according to the present invention, an improved drying of the leather side is achieved as compared with the traditionally-known boards, where the drying of the pelts in these areas is almost impossible to accomplish.

With the pelt board according to the invention, there are thus achieved two important advantages, i.e. the possibility of using a completely new and more effective drying technique for drying the leather side of a pelt, where the drying takes place by replacement of the air under the holes/perforations in the distension element/pelt board on which the pelt is stretched, and not as hitherto by the blowing of drying air into a slot-shaped opening in a traditional board, with the limitations of the drying effect that this involves. The second important advantage is that the pelt stretched on the pelt board can be stretched out to a hitherto unknown extent, and be fixed in this stretched position during the drying process without any use whatsoever of clips/staples.

With the use of the method and the pelt board according to the invention, at one and the same time there is thus achieved the possibility for an effective drying of the leather side of the pelt, so that there are no areas left on the leather side of the pelt which have not been dried, and which herewith can be attacked by mites, while at the same time the stretched size of the pelt is maintained solely by use of the fixing bag without the use of hole-creating fixing clips.

It will naturally be possible to use a traditional fat-absorbing pelt bag in connection with the pelt board according to the invention, but this will be able to be rendered superfluous, which will be explained later.

The pelt board/distension element with arched form according to the invention also has a shape which corresponds closely to the boards traditionally used where the stretching along its first transverse axis (breadth axis) is concerned, in that the extent of the board in relation to the length axis in the direction of the first transverse axis and the second transverse axis is more or less evenly decreasing in the direction towards the front end which is pointed though rounded, outwardly from an area of the board near the foot end, where the extent of this in the direction of the first transverse axis and the second transverse axis is more or less constant, as is disclosed herein. Here, it shall be mentioned that pelt boards with this shape are principally intended for use in the drying of pelts from male furred animals.

An embodiment of the pelt board where the extent of the board in relation to the length axis in the direction of the first transverse axis and the second transverse axis is more or less evenly decreasing in the direction towards the front end, which is pointed though rounded, will be suitable for the drying of pelts from female furred animals.

In a first further embodiment, the surface of the pelt board can comprise a first grooving oriented in the longitudinal axis, as disclosed herein. The possibility is hereby achieved for a free flowing of exchanged air from the ends of the board between the leather side of the pelt and the surface of the board, which will make the drying of the pelt considerably more effective as compared to the use of the known pelt boards.

Since the extent of the first grooving will hardly be necessary over the whole length of the board, but solely in and around the area where the leather side of the pelt is pressed in against the board's surface under the influence of the pressure from the fixing bag, and that there is also a need for the greatest possible free cavity for distribution of the drying air in the remaining part of the board where this is narrower, the first grooving in the surface of the board can be limited to an area of the board closest to the foot end, and extending to a distance from the foot end where the extent of the board in the direction of the first transverse axis and the second transverse axis is more or less constant, to and including a part of the area where the extent of the board in relation to the longitudinal axis in the direction of the first transverse axis and the second transverse axis is more or less evenly decreasing in the direction towards the front end, as disclosed herein.

It will be obvious that said channels in an embodiment of the pelt board can stand in connection with the already-mentioned through-going slot in the board.

With the view of ensuring a further resistive securing of the pelt stretched on the pelt board according to the invention, the surface of the board can have a second grooving/serration in relation to the orientation of the first grooving, as disclosed herein. The fixing of the pelt stretched on the board will hereby be significantly increased, and the amount of the necessary transverse force on the fur side of the pelt stemming from the fixing-bag, which is necessary to counteract contraction of the pelt along the longitudinal axis during the drying, can be reduced as compared with a board having a top surface which does not comprise the transverse grooving/serrations. The reduction of the transverse force necessary for the fixing of the pelt stretched on the pelt board can result in the fur side of the pelt not being loaded to such a great extent.

In one embodiment, where the area of the transverse grooving/serration stands in connection with the grooving of the board's surfaces oriented in the longitudinal axis of the board, the transverse grooving/serration can also result in a further improvement of the exchange of air between the board and the leather side of the pelt during the drying process.

In a special embodiment of the pelt board, the extent of the second transversely directed grooving/serration can be limited to a part of the area of the board closest to the foot end, and at a distance from the foot end where the transverse axis is more or less constant, to and including a part of the area where the extent of the board in relation to the longitudinal axis in the direction of the first transverse axis and the second transverse axis is more or less evenly decreasing in the direction towards the front end, as disclosed herein.

With the view of achieving a further optimal securing of the pelt in its stretched-out position of the pelt board, the tops of the transverse grooving/serrations can be aligned, and the course between two successively following groove tops outwardly from a groove top closest to the foot end towards the front end, can be inclined towards a more or less plane course, and where the course between the more or less plane course to the following groove top can be more or less vertical, as disclosed herein.

With the view of being able to provide an easier removal procedure when the drying of the pelt stretched and secured in this position on the pelt board has been carried out, this can be achieved with two similar half parts combined with locking means/assembly means, the facing edges of said half parts defining an envisaged first plane which is substantially coincident with the first transverse axis (breadth axis), and whose sides facing away from each other extend in an arched manner, and where the locking/assembling means are arranged so that the two half parts are relatively displaceable away from and towards the first plane, between a first outer position where a slot-shaped opening arises between the subtending sides of the half parts, and a random position where said sides can be in contact with each other, and where between the half parts there can be inserted forcing means for locking of the half parts in the first outer position, as disclosed herein.

In this embodiment, the stretched pelt drawn onto the two half parts constitutes a part of the defining of the cavity under the perforations.

With the use of the forcing means there can be achieved an easy removal procedure, which consists of the two half parts of the board (possibly with a fat-absorbing pelt-bag applied) before being provided with a pelt, are provided with forcing means whereby the half parts are locked in a position where a slot-shaped opening arises between the subtending surfaces of the half parts. Hereafter, the pelt is stretched out on the board and secured by means of a fixing-bag. In the removal procedure, the forcing means are removed, whereby the half parts can easily be displaced towards each other, whereby the counter-hold which contributes towards the fixing of the pelt on the board disappears, and both pelt and pelt-bag can easily be removed from the board.

In order to provide optimal conditions for the blowing-in/replacement of drying air between the surfaces of the board and the leather side of the pelt, the two similar half parts can consist of a first half shell and a second half shell, which in combination define a cavity which is open at the foot end of the board, and said cavity stands in connection with the holes/perforations in the surfaces of the board, as disclosed herein.

There is hereby combined the desire regarding a light construction in combination with the advantages with good possibilities for replacement of the air in the pelt board's cavity, and herewith the drying of the leather side of the pelt, in that the shorter the distance between the leather side of the pelt and the cavity, where replacement of the drying air takes place, the more effectively the drying procedure will progress.

As mentioned earlier, here it is also preferred that the locking means between the first half shell and the second half shell are arranged in such a manner that the two half parts are relatively displaceable away from and towards the first plane, between a first outer position where a slot-shaped opening arises between the edges of the half parts, and a second outer position where the facing edges of the half parts can be or are in contact with each other, and where the pelt board comprises forcing means (which can be activated) for locking of the half parts at least in the first outer position, as disclosed herein.

It shall be mentioned here that the forcing means are integrated in the pelt board construction, but the invention shall not be limited to exclusively comprise integrated forcing means in embodiments where the pelt board consists of at least two or more half shells.

A possible embodiment of the pelt board, where the forcing means are integrated in the board construction, between the two half shells on the subtending sides of said shells, and projecting from said shell sides, there can with advantage be provided a number of similar but laterally reversed pins with freely projecting ends respectively comprising a plane side and from here, in the direction towards the respective pins securing area in the respective facing sides and towards the foot of the board, sloping sides, and where the plane sides terminate on a level near the first plane, and between said half shells an element which is displaceable in the longitudinal direction to assume an advanced position and a retracted position, where the element comprises wedge-shaped projections which in the advanced position of the element are localised pressed in between the plane sides of the pins, and where the wedge-shaped projections in the element's retracted position are placed outside the plane sides and the sloping sides of the pins, as disclosed herein.

An alternative embodiment can comprise that between the two half shells, on the subtending sides of said shells and projecting out from these, there are provided a number of similar but laterally reversed pins with freely projecting ends respectively comprising a plane side, and from here sides sloping in the direction towards the respective pin's securing area in the respective facing each other sides and towards the foot of the board, and where the plane sides terminate on a level near the first plane, and between said half shells an element which is displaceable in the longitudinal direction to assume an advanced position and a retracted position, where in its advanced position the element is localised pressed in between the plane sides of the pins, and where the element comprises slots or holes placed in the vicinity of said pins, which with the element in the retracted position are placed opposite the plane sides of the pins.

In a simple and easy manner, it will hereby be possible to effect a locking of the two half parts of the pelt board in the distended position before processing of the pelt on the board takes place, simply by sliding the element forward to the advanced position, and in connection with the processing of the pelt after the drying procedure it will be relatively simple to free the pelt from the board by drawing the element back, so that the two half parts can be displaced towards each other.

With the view of providing the board with a certain static stability, so that this maintains its shape stability when absorbing the forces which influence the board during the stretching and the fixing of the pelt on the board, the board can be configured so that the facing sides of the half parts comprise stiffeners, as is disclosed herein. This opens the possibility of being able to produce the pelt board in a material with relatively low density, for example, plastic etc.

In a possible embodiment of the pelt board, it can be preferred that the similar laterally reversed pins are projecting from the stiffeners, as is disclosed herein. This will result in a saving in, e.g., the production of a mould for the identical half shells, and also a saving of the material used in the production of the respective half shells.

In a preferred embodiment of the board, where this comprises a first half shell and a second half shell, the element displaceable in the longitudinal axis can be plate shaped, and be disposed in the first plane between the two half shells as disclosed herein.

In this connection, it can further be preferred that the facing sides of the half parts comprise projecting parts which cooperate with holes and cut-outs in the plate shaped element for the orientation of and the control of the spreading of the plate shaped element which is displaced in the longitudinal direction, as disclosed herein.

The pelt board hereby becomes a compact unit without the need for external means for the removal of the pelt which is stretched, fixed in this position and dried.

The locking means for the joining of the half parts can consist of the cooperating elements projecting from the respective facing sides of the half parts, comprising first projections and further projections with openings for engagement of said first projections, where the geometries of the openings in the further projections and the first projections are mutually fitted (with locking means) in such a manner that after being pressed into the openings in the further projections, the first projections are secured in a displaceable manner in said openings, as disclosed herein.

It is hereby achieved that the identical half parts/shells can be joined/assembled in an easy and simple manner by a "click" assembly, by bringing two identical half parts opposite each other, and pressing these against each other so that the first projections are pressed into the openings in the further projections, whereby the first projections are locked in a displaceable manner, so that the half parts/shells can be displaced towards and away from each other. The advantage hereby, in addition to the pelt board being quick to assemble, is that use shall not be made of special assembly means, such as, e.g., screws etc. for the assembly of the half parts/shells, which results in a reduction in the production costs for the pelt board.

In a further embodiment, the forcing means integrated in the board can further comprise means for displacement of the two half parts/shells from the first distended position, to a second position where the edges of the two half parts/shells are in contact with each other, i.e. by displacing the forcing means to the retracted position, as disclosed herein.

There is hereby achieved a forced control of the half parts/shells towards each other (collapse) by displacing the forcing means from the first position where there is a slot between the half parts/shells, to a position where said half parts/shells are pressed against each other. The advantage herewith is that at least a part of the surface of the board is released from the leather side of the pelt, which after the drying process has become relatively stiff, and moreover can have adhered to the open structure which comprises the surface of the board. After release of at least a part of the surface, it will be relatively easy also to release the remaining part of the pelt's leather side from the surface of the board.

In a further preferred embodiment of the distension element according to the invention, said further means can consist of tongues on the plate-shaped element, said tongues having sloping wedge surfaces which from a plane surface nearest the free ends of the tongues decrease in the direction towards the tongues' starting points, said sloping wedge surfaces and plane surfaces cooperating with side surfaces in bridges on the facing sides of the half shells, in which bridges tongues are introduced in the assembly of the distension element/pelt board, as disclosed herein.

In the retraction of the plate-shaped element to the second outer position, the sloping wedge-shaped surfaces are pressed in against the herewith cooperating side surfaces of the bridges, whereby a traction oriented towards the first plane is exercised in the half shells, so that the edges of the two half shells are hereby displaced in said direction and are brought into contact with each other, whereby the circumference of the distending element/pelt board is reduced. There is hereby ensured an effective freeing of the leather side of the pelt from the surface of the board.

It is also preferred that the free ends of the tongues comprise a projection which, in the assembly of the pelt board, which comprises a first half shell and a second half shell consisting of identical laterally reversed elements and the plate-shaped element, which after being brought into a start position between said two half shells with the free ends of the tongues placed opposite the pair-wise facing each other bridges on the two half shells, is moved from the start position in the direction towards the front end of the half shells, by which movement the tongues and therewith the projections are pressed in through the openings in the bridges, so that the projections are displaced to a position behind a bridge side which faces away in relation to a starting point of a tongue, whereby the plate-shaped element will subsequently be able to be moved between the outer positions, as disclosed herein.

There is hereby further achieved that the assembly of the individual parts which together make up the distension element/pelt board can be carried out in a quick and easy manner, which reduces the production costs of the pelt board according to the invention. Moreover, there is achieved a particularly effective and precise locking/placing of the individual parts of which the pelt board consists, and also a well-defined control of the possible displacement of the plate-shaped element.

With the view of preventing the leather side of the pelt from being pressed into the slot-shaped opening between the half shells in the advanced position of the plate element, where in connection with the processing of the pelt a tightly-sitting fixing bag is drawn over the fur side of the pelt, which presses the pelt against the surface of the board, and herewith relevant parts of the leather side into the slot, along a part of the side edges the plate-shaped element can further comprise V shaped tracks for engagement of the control pins projecting from the facing sides of the first half shell and the second half shell respectively, so that by displacement of the plate-shaped element to the advanced position, the said side edges are displaced in the sideways direction away from the longitudinal axis to a position where the side edges fill out the slot-shaped opening between the edges of the half parts, whereby in the distended position of the distension element/pelt board they constitute a part of the outer side surface of the board, as disclosed herein.

It is hereby achieved that by the displacement of the plate-shaped element, the slot which arises between adjacent side surfaces of the half shells is blocked for entry of the leather side of the pelt in the area where the fixing bag presses against the pelt, the result being that the pelt will be even easier to remove after the displacement of the plate-shaped element to the retracted position has been carried out, whereby the circumference of the board is reduced, in that the leather side of the pelt will not block for displacement of said side edges until these are in mutual contact with each other.

With the view of ensuring good drying-out of the pelt in the areas where the fixing bag presses the leather side of the pelt against the side edges of the plate-shaped element, the side edges can have a corrugated extent, so that between these and the edge ends of the facing sides of the half shells, channels are formed which stand in connection with the cavity which is defined by the half shells, as disclosed herein.

It is further preferred that that part of the plate-shaped element (64), where the side edges which comprise the V-shaped tracks preferably extend over the area where the fixing bag presses the pelt against the surface of the board, i.e. between the foot end and at a distance from the foot end, where the board's extent in the direction of the first transverse axis and the second transverse axis is more or less constant, to and including a part of the area where the extent of the board in relation to the longitudinal axis in the direction of the first transverse axis and the second transverse axis is more or less evenly decreasing in the direction towards the front end, as disclosed herein.

With the view of easing the retraction of the plate-shaped element in connection with the removal of the pelt, in extension of the end nearest the foot end of the board, the plate-shaped element can comprise a short projecting element which extends outside the foot end of the board, as disclosed herein.

It is further preferred that the short projecting element comprises holding surfaces, as disclosed herein. It is expedient to have these holding surfaces available in connection with displacement of the plate-shaped element between the first and the second outer position. It is also preferred that the short projecting element is pointed as disclosed herein.

In a special further embodiment of the pelt board, the short projecting element can comprise a wedge-shaped part which is substantially oriented transversely to the longitudinal axis of the board, as disclosed herein.

It hereby becomes possible in an easy and simple manner, from the foot area of the board, where this is placed in a drying aggregate comprising transversely displaceable means (cf. below) cooperating with the wedge-shaped part, to activate the plate-shaped element for a bringing-together of the half parts of the pelt board, whereby a freeing of the pelt is made possible.

In a particularly preferred embodiment of the distension element/pelt board according to the invention, the short projecting element can comprise protruding ribs which extend parallel in the longitudinal axis, arranged in parallel with the second transverse axis (height axis), said ribs further extending over a part of the plate-shaped element, and that the facing sides of the half shells comprise longitudinal ribs which extend parallel with the ribs protruding from that part of the ribs which extend over the plate-shaped element, where by their mutual positioning and extent the ribs form a channel for the blowing-into or sucking-out of drying air from the pelt board's cavity, as disclosed herein.

The short projecting element is hereby used as guide/channel for the blown-in drying air, which is supplied from the board's lower end, from the drying aggregate associated with the drying system. With the use of said channels, it is achieved that the drying air is led a relatively long distance up in the interior of the board before the air is distributed to the cavity in the board, and herewith to the leather side of the pelt. The result is that the drying air is distributed better and more expediently than would be possible merely by blowing the drying air into the board's cavity from underneath, or via tubes inserted through the jaw part of the pelt. The improved distribution of the blow-in drying air, where it is sought to distribute the air with ⅔ which flow downwards and out through the perforations (the open structure of the board's half parts) in the area at the lower end of the board, and ⅓ up through the upper end of the board, where the air is led out through the pelt's jaw part, results in a considerable improvement of the drying of the pelt in the area where the front paws are placed and where the pelt lies in three layers.

It is further preferred that the ribs extend between the foot end, and at a distance from the foot end, where the board's extent in the direction of the first transverse axis and the second transverse axis is more or less constant, to and including a part of the area where the extent of the board in relation to the longitudinal axis in the direction of the first transverse axis and the second transverse axis is more or less evenly decreasing in the direction towards the front end, as disclosed herein, whereby the air supplied is led in the channel to the area in the proximity of the position of the front paws on the surface of the board.

It is further preferred that the distance between the ribs on facing sides of the half shells is narrowed down at that end of the board which is nearest the board's upper end (the cranium end), in an area which does not comprise longitudinal ribs on the plate-shaped element, as disclosed herein.

This contraction of the channel will bring about that resistance which is necessary to ensure the above-mentioned distribution of the air inside the board's cavity.

With the view of ensuring an effective replacement of the air in the board's cavity, the surfaces at the front end can comprise a number of slot-shaped openings, as disclosed herein.

There is hereby ensured a possibility of the implementation of an effective flow of air through the board's cavity, and that the correct distribution of the supplied drying air takes place in the cavity.

In certain cases the cranium end of the pelt from a furred animal can have been damaged during the skinning procedure, so that this will not hang firmly onto the front end of the board in the normal way and form a counter-hold for the pelt in connection with the stretching of this on the board. With the object of being able to dry said damaged pelt by means of the method and the pelt board according to the invention, the front end of the board can comprise means for securing the nose end of a pelt applied to and stretched on the board to the front end, as disclosed herein.

As disclosed herein, said means can with advantage consist of short, spaced, projecting, parallel pins arranged parallel with the longitudinal axis, standing out from the pointed end of the respective half shells. The pelt can hereby be effectively controlled/secured by introducing said pins through the nose holes of the pelt.

With the view of ensuring good access conditions for mechanical elements for the removal of the dried pelt from the board, the area of the pointed end of the half shells between the facing sides of the pins can be bevelled, as disclosed herein.

With the view of further improving the possibilities of drying that area of a pelt on the distension element/pelt board according to the invention where the front paws are placed, the surfaces of the board can comprise spaced longitudinal recesses/grooves in an area which extends from near the pointed/cranium end towards that area of the distension element/pelt board where its extent in the direction of the first transverse axis and the second transverse axis is more or less constant, as disclosed herein.

It is hereby achieved that the pelt, in the area around the front paws where the pelt lies in three layers, is not pressed together to such a great extent, which in combination with the above-mentioned channelling and distribution of the drying air in the board's cavity, results in an extremely effective drying-out of this area of the pelt from a furred animal, which is otherwise very difficult to dry out.

As already mentioned, with the invention there is provided a distension element/pelt board which makes the use of securing clips/staples completely unnecessary in connection with the fixing of a stretched pelt on the board. This means that the board no longer needs to consist of a material which is suitable for the driving-in and securing by clips/staples (hitherto wood). This provides possibilities of selection of that material from which the board is made, bearing in mind that pelt boards of wood are also damaged by the influence of fat which may remain on the leather side of the pelt after skinning, which entails that use is often made of a fat-absorbing material, e.g., in the form of a pelt-bag, which is stretched onto the board before the application of the pelt.

With the invention, however, it will be realised that with the new construction of the pelt board, the selection of a suitable material for production of the board can render the use of said fat-absorbing pelt-bag superfluous, in that the board can consist e.g. of plastic, polymeric or fibre-reinforced plastic material, or combinations of said materials, as disclosed herein.

The advantage herewith is that certain types of said materials are resistant to fat, and merely by a simple washing of the board after the pelt processing season has been concluded, the period of time for which said boards will be able to be reused will therefore be unlimited.

It is further preferred that the board is made of polystyrene, and further it can be mentioned that injection moulding of the parts comprising the board has proved to advantageous, as disclosed herein.

The result of the use of the above-mentioned materials and methods of production is that the board construction becomes light and also statically stable.

Furthermore, there is achieved the advantage that by the pelt board according to the invention consisting of such materials, it becomes easy to clean compared with the known pelt boards of wood, and the plastic material does not absorb fat.

In a particularly preferred embodiment of the invention, at least the half parts (the half shells) are made of fat-absorbing material of the kind which can consequently be washed, the result being that the fat is washed out of the material which thus again becomes capable of absorbing fat. The use of pelt-bags for the collection of fat can hereby be completely omitted, while at the same time the residual fat on the leather side of the pelt is removed by the board.

For use with the system for the drying of the leather side as disclosed herein, and in cooperation with the distension elements, there is an associated drying aggregate. An embodiment of this can comprise an encapsulation which defines a cavity, and an air replacement arrangement for the changing of the air existing in the cavity, said encapsulation comprising at least one upwardly-facing surface with a multiple of first openings, and under said surface a multiple of substantially U shaped profile rails arranged in parallel, the geometry and number of which correspond to the first openings, where said openings cooperate with a projecting element which extends outside the foot end of a distension element/pelt board for the placing of at least one, preferably a multiple, of distension elements/pelt boards standing upright from the upwardly facing surface, with the foot end of the board in contact with the upwardly-facing surface, and further openings near the foot ends of the respective boards, so that the further openings stand in connection with the cavities in the respective distension elements/pellet boards which are placed in the upwardly-facing surface, so that the air in the cavity of a distension element/pelt board which is placed in the upwardly-facing surface is changed by replacement of the air in the cavity by the air replacement arrangement, as disclosed herein.

The advantage with the aggregate is that manipulation with pipes, suspension of the board with the processed pelt is rendered superfluous, simply because after the application and the stretching of the pelt etc., the pelt is set to dry merely by placing the board on the drying aggregate, in that the air inside the board is changed via the lower end (the foot end) of the board which has an opening to the cavity. Thus when drying air is blown with over-pressure into the drying aggregate's encapsulation cavity, this air will flow into the board's cavity via the opening in the foot end, and drive out the air already existing in the board's cavity, this air being evacuated via the open structure at the foot end of the board.

Moreover, time is saved since it is hereafter necessary to handle the board with the pelt only once before the drying procedure is initiated, as compared with the hitherto-known method where the boards with the pelts are first transported in bulk to the drying room, after which the are hung up individually, and the subsequent drying is effected by inserting a pipe for the blowing-in of drying air through the jaw part of the pelt and placing it in the slot-shaped opening in the board.

It will be recalled that the pelt board according to the invention also comprises a part extending below the foot end. This part is used to hold the distension elements in the upright position in relation to the upwardly facing surface of the drying aggregate by leading the part down though the holes in the upwardly-facing surface, Said part is also connected to the plate-shaped elements which constitute the forcing means which ensure that the board's half parts/shells are lying in the first outer position, with a slot-shaped opening between these, and remain in this position during the drying process. Said part further comprises holding surfaces which are intended for engagement with cooperating means for displacement of the plate-shaped elements between outer positions. As also mentioned earlier, a displacement of the plate-shaped element towards the foot end results in the half parts/shells of the board being able to be released and displaced towards each other, and with special embodiments of the half shells and the plate-shaped elements the displacement of the half shells towards each other will be force controlled.

However, to have to carry out the displacement of the individual plate-shaped elements in each distension element/pelt board would require considerable manual work.

With the object of minimising and simplifying the work involved in the handling of the distension elements/pelt boards after conclusion of the drying process, where the distension elements/pelt boards with the pelts stand placed, e.g., on racks in the drying aggregate, with the invention it is realised that it is expedient to arrange the drying aggregate so that a multiple of distension elements/pelt boards, for example one or more rows at a time, can be released by a single operation.

This is possible with a further embodiment of the drying aggregate, where the first openings and the additional openings are arranged in rows extending in parallel in the upwardly-facing surface, and where in the cavity under said surface, in the ribs of the U-shaped profile rails, there are displaceable drawplates arranged in parallel with the upwardly-facing surface, said drawplates having similar through-going cut-outs for engaging the projecting element which extends outside the foot end of a distension element/pelt board, and where each through-going cut-out comprises a projection which cooperates with comprises the wedge-shaped part of a projecting element which is substantially arranged transversely to the longitudinal axis of the board, so that a displacement of a drawplate between a first outer position, where the projections are not in engagement with the wedge-shaped part, to a second outer position where the projections are in engagement with the wedge-shaped part, will give rise to a displacement of the forcing means/the plate-shaped element, so that the slot-shaped holes or cut-outs in the plate-shaped element are moved to a position opposite the plane sides of the pins, whereby the subtending sides of the half parts become displaceable/controlled to a position where the subtending sides/edges of the board are lying closer to each other, as disclosed herein.

There is hereby achieved the advantage that the half parts of the distension elements/pelt boards can be released for displacement towards each other by a simple operation, where the drawplates are displaced, whereby the distension elements which lie in the relevant axis are released. It will also be possible to arrange mechanical displacing means in connection with the drying aggregate, or externally, which can be set for displacement of selected drawplates or all drawplates for releasing/displacement of the half parts of the distension elements/pelt boards.

With the view of providing the necessary access to the drawplates for the displacement of these, the drawplates can comprise freely projecting parts through a side of the encapsulation, said parts comprising though-going openings for establishing traction facilities for displacement of the drawplates, as disclosed herein.

A drying aggregate for use with the distension elements/pelt boards is characterised in that it comprises an encapsulation which defines a cavity, and an air replacement arrangement for the changing of the air existing in the cavity, said encapsulation comprising at least an upwardly facing surface with a plurality of first openings, and under said surface a plurality of substantially U-shaped profile rails arranged in parallel, the bottoms of which comprise opening with geometry and number corresponding to the first openings, said opening cooperating with the projecting element which extends outside the foot end of the distension element/pelt board for the placing of at least one, preferably a plurality, of distension elements standing up from the upwardly-facing surface, with the foot end of the board in contact with the upwardly-facing surface, and where the exchange of air in the cavity in the board takes place by the blowing-in of air by the air displacement arrangement, said air being supplied to the board's cavity via the channels defined by said ribs, and where the air is distributed in the board in the area where the distance between the ribs on the subtending side surfaces of the half shells is reduced, so that approx. ⅓ is led out through the openings in the board at the front end (14) and approx. ⅔ is led out via the open structure at the board's foot end, as disclosed herein.

The drying aggregate can further be arranged so that the encapsulation comprises displaceable elements which cooperate with the holding surfaces on the short projecting element, the activation of which result in a displacement of the forcing elements oriented in the longitudinal axis of the board, and in a direction away from the board's foot end, whereby the forcing elements assume their second outer position, as disclosed herein.

With the object of being able to utilise the drying aggregate as a means of transport for the distension elements/pelt boards with the processed pelts, the drying aggregate can be placed on wheels.

The drying aggregate, completely or partly filled with pelt boards with pelts, can hereby easily be brought to the place where the drying process is to take place.

The carriages normally used for the transport of the pelt boards can thus be dispensed with.

In one embodiment of the drying aggregate, the air replacement arrangement for the exchange of air in the cavity in the encapsulation of the drying aggregate can comprise a blower unit, as disclosed herein, said blower unit can be integrated with the encapsulation, but can also be connected with this by a pipe connection.

Alternatively, in a further embodiment, the air replacement arrangement for the exchange of air in the cavity in the encapsulation of the drying aggregate can consist of a suction unit which can be integrated with the encapsulation. The suction unit can be integrated with the encapsulation, but can also be connected with this via a pipe connection.

There is hereby achieved the advantage that the drying aggregate can simply be placed in a room with a preferred temperature and humidity, e.g., a temperature of 18° C. and a relative humidity of 55%, after which the blower unit/suction unit is started and the drying air is blown/sucked into the board's cavity.

All in all, with the method, and the system for the execution of the method as disclosed herein utilizing the pelt board according to the present invention, there is provided a new generation of distension elements/pelt boards for use with the drying process in the production of pelts, which at the same time solves the problems with the securing of the pelts stretched and secured in this position on the board during the drying procedure, without the use of securing means which penetrate and damage the pelts, an improvement of the drying of the leather side of the pelt, with the result that the dried pelts do not have "black spots" (areas not dried), and the possibility for a significant saving in the labour in connection with the removal of the dried pelts.

In this connection it shall be noted that the inventor has recognized that the pelt board according to the invention can assume other configurations than those described, for example the board can be divided into several part segments around the longitudinal axis, where the opposing segments could be relatively displaceable in relation to planes defined by subtending sides of the part segments.

In the following, the invention will be explained in more detail with reference to the accompanying drawings.

DETAILED DESCRIPTION OF THE INVENTION

Figure 1:
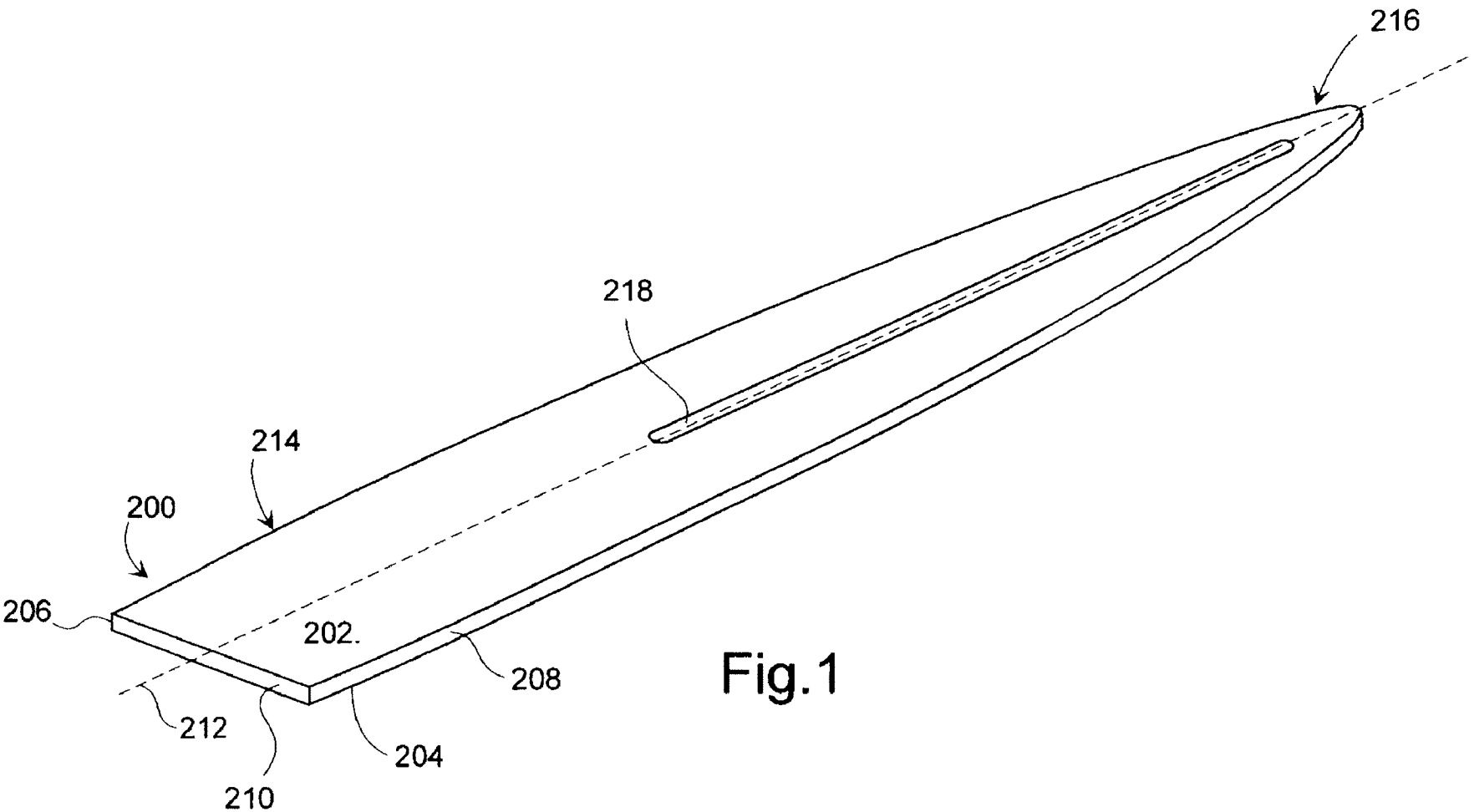
FIG. 1 is a perspective view of a known pelt board for use in the drying of the leather side of a furred animal pelt.

FIG. 1 shows an illustration of a pelt board 200 of the traditional type, which is used in connection with the drying of pelts 4 from furred animals. In the embodiment shown, the board is intended for the drying of mink pelts. The board 200 is typically made of wood, and can briefly be described as a flattish piece of wood with a first broad-side surface 202 and a second broad-side surface 204, and a first narrow-side surface 206 and a second narrow-side surface 208, the breadth of which is substantially smaller than the breadth of the broad-side surfaces, and where the one end 210 of the board (the foot end) is cut off at right angles to the longitudinal axis 212 of the board, and the lower end 214 nearest the foot end has constant breadth, but hereafter this breadth gradually decreases towards the pointed but rounded end part 216 (the front end, the nose end), and where the board has a through-going slot 218 between the first broad-side surface 202 and the second broad-side surface 204, said slot 218 lying symmetrically around the board's longitudinal axis 212 and extending between near the pointed end part 216 and at least over a half part of the length of the board. The pelt board described above is intended for pelts from male animals, which are normally larger than pelts from female animals. A pelt board intended for use in the drying of the leather side of the pelt from female animals does not comprise a lower end where the breadth of the board is constant. As already mentioned, the use of such a board involves certain significant disadvantages, of which can be mentioned the lack of effective drying of the pelts in places where the leather side lies tightly up against the board, more precisely in the areas along the board's narrow side surfaces 206 and 208. Moreover, the securing of the pelt in the stretched position on the board during the drying with the use of a fixing-bag alone is not possible, the reason being that the drawn-over fixing-bag can not exert sufficient pressure on the outer side of the pelt for the leather side to be pressed to the necessary degree for the creating of the friction between the broad-side surfaces 202 and 204 necessary for securing the pelt, where typically in the areas at least on each side of the tail root of the pelt there are inserted fixing clips/staples so that these parts of the pelt can not slip during the drying process. Finally, it can be mentioned that the removal of pelts dried on said known boards involves considerable work, in that the securing clips must be removed and the pelt jerked free of the board, which entails some degree of force.

Figure 2:
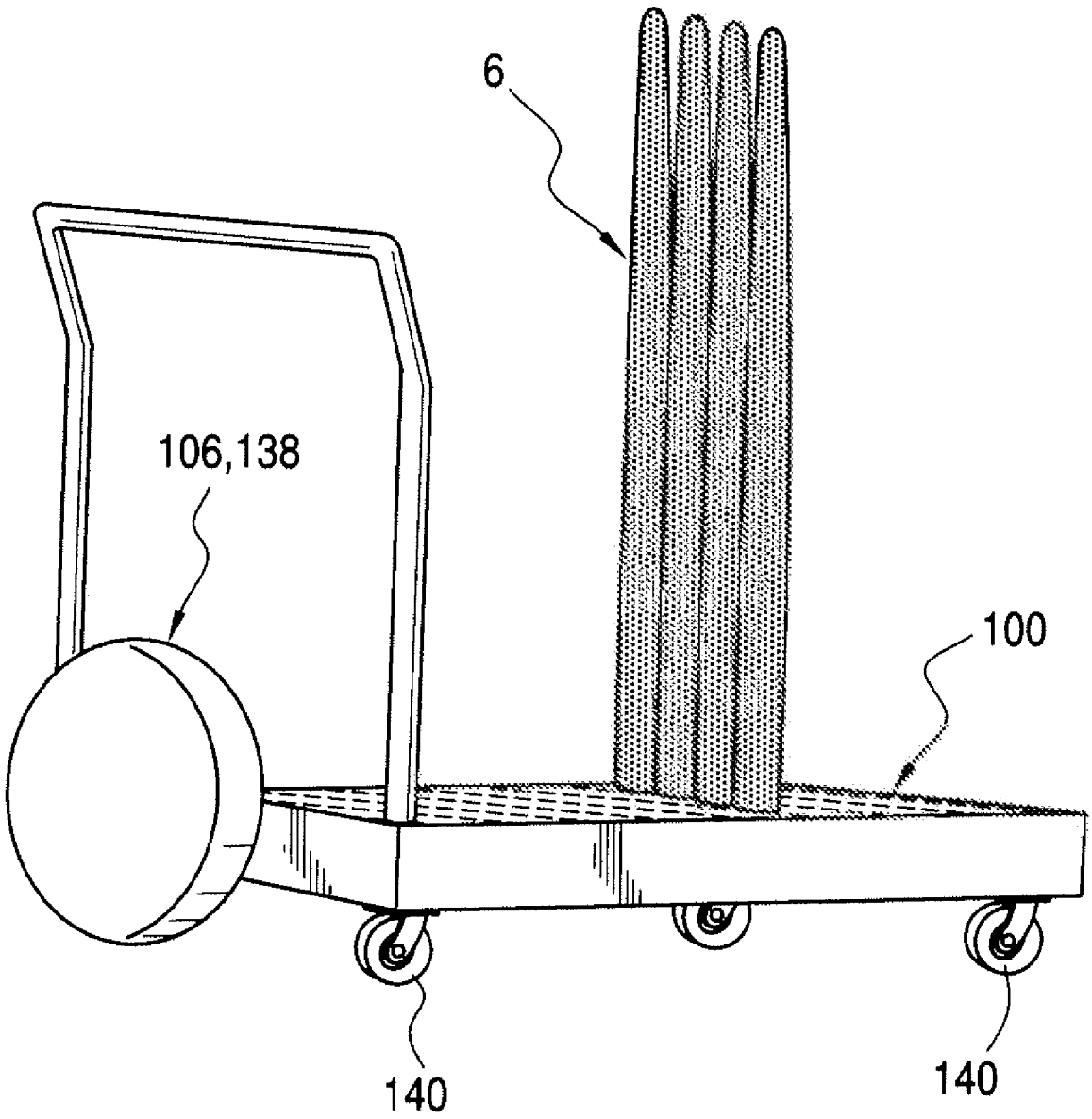
FIG. 2 is a perspective view of a system for the drying of the leather side of a furred animal pelt according to the invention.

FIG. 2 shows a system for use in the drying of the leather side of pelts (not shown) from furred animals. The system comprises a distension element/pelt board 6 on which a pelt is mounted and stretched, the pelt being held in the stretched position during the drying with the leather side (not shown) against the surface of the board. The board 6 is hollow and elongated and comprises a front end 14 and a foot end 16, the surface of which in the shown embodiment has an open structure in the form of holes 10 in the surface 12. The pelt board 6 is open at the foot end 16, which cooperates with a drying aggregate 100 comprising an encapsulation 102 which defines a cavity 104, which in turn is connected with an air replacement arrangement 106 which, in the shown embodiment, comprises a blower unit 138 mounted on the outside of the encapsulation 102. The encapsulation 102 comprises an upwardly-facing surface 110 with first openings 112 which cooperate with a lower part 68 of the pelt board which extends at the bottom of the foot end 16 for securing distension elements/pelt boards 6 inserted in the openings, so that these are secured in an upright manner with the foot end resting on the upwardly facing surface 110. The upwardly-facing surface 110 comprises further openings 120, 120'which are placed at such a distance from the respective first openings 112 that these lie within the limit of the foot of the board, so that the air in the cavity 8 of a distension element 6, which is placed in the upwardly-facing surface 110, is exchanged by the replacement of the air in the cavity 104 by the blower unit 138.

Figure 3:
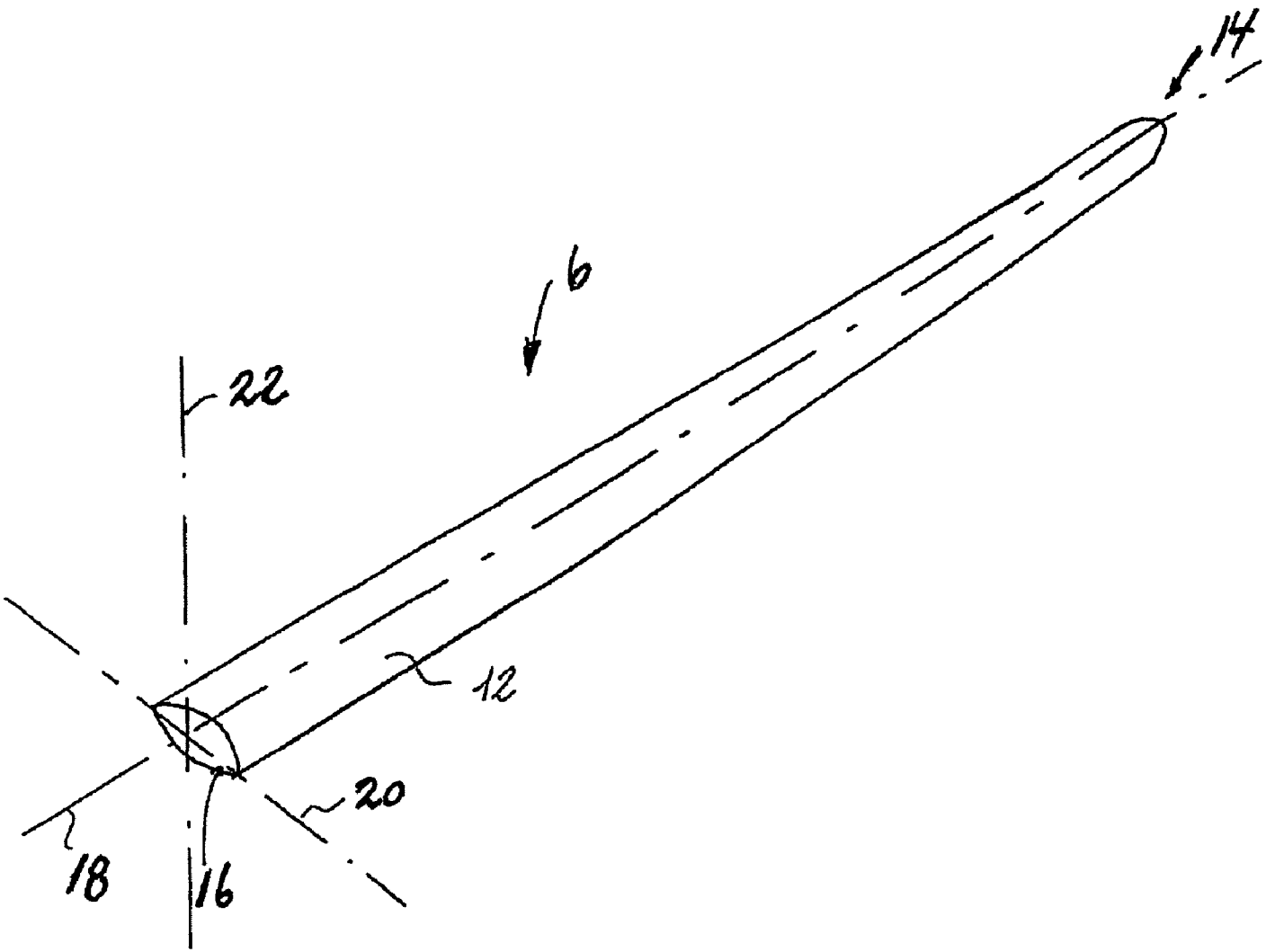
FIG. 3 is a perspective view of a first basic embodiment of a distension element/pelt board according to the invention.

FIG. 3, which is a perspective view of a first basic embodiment of a distension element/pelt board 6 according to the invention for use in the drying of pelts (not shown), where drying of the pelt is effected by drying the leather side (not shown) of a pelt 4 stretched and fixed in this position on a pelt board. The pelt board 6 has a longitudinal axis 18, a first transverse axis 20 (breadth axis) and second transverse axis 22 (height axis), a front end 14 for engagement in the cranium end (not shown) of a pelt, and a foot end 16 which is terminates preferably at right angles in relation to the board's longitudinal axis 18. The special aspect of the pelt board 6 is that it is configured symmetrically around at least two of the defined axes 18, 20, 22. As appears clearly from FIG. 3, the pelt board 6 according to the invention thus has a "tubby" shape between the foot end 16 and the front end 14.

The result is that between the surface 12 of the board and the leather side of a pelt applied and stretched on the board by means of a fixing-bag which is drawn over the outside of the fur side of the pelt, a pressure can be created which is sufficient to secure the pelt in the stretched position on the board 6 during the drying process. It does not appear from the shown embodiment to what degree the board is hollow, nor how its surface is configured, in that the object of this figure is to illustrate the basic features of the surface shape, the result of which is that the completely clip/staple free fixing of the pelt by use of the board 6 according to the invention is possible. In this embodiment, the board 6 can be solid and be provided with longitudinal and/or transverse grooves which allow replacement of the air between the leather side of a pelt applied to, stretched on and fixed to the board.

Figure 4:
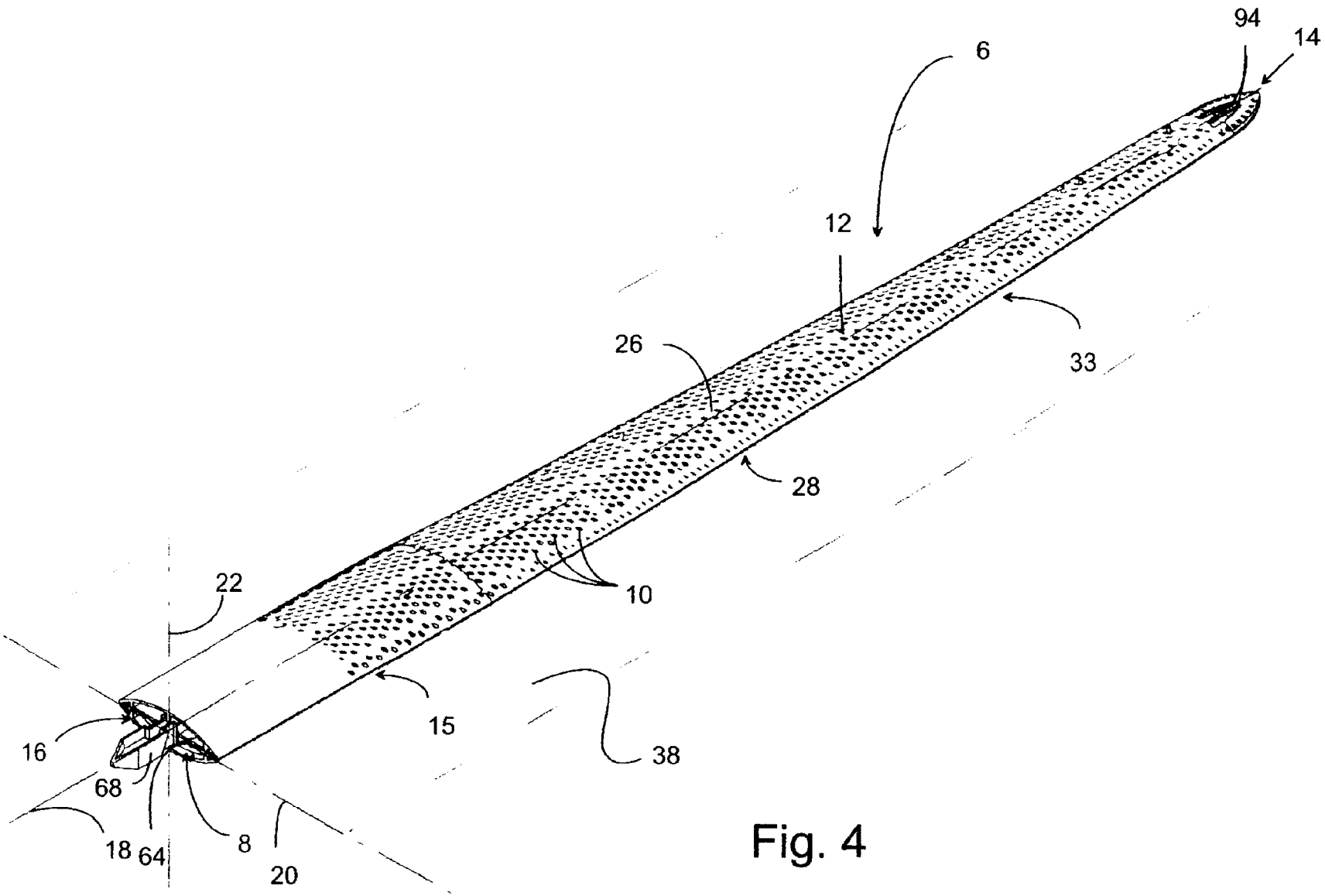
FIG. 4 is a perspective view of a second embodiment of the distension element/pelt board according to the invention shown in FIG. 3.

In FIG. 4 is shown a second embodiment of the board 6. This has the same shape as the board shown in FIG. 3, but where the nature of the surface 12 as an open structure appears clearly as a consequence of the holes 10 in the board. In the shown embodiment, the surface 12 is provided with holes 10 between the front end 14 and to a distance in the area 15 of the board 6 near the foot end 16, where the extent of the board in the direction of the first transverse axis 12 and the second transverse axis 14 is more or less constant.

Already here it shall be mentioned that the inventor has realised that the holes 10 can assume another configuration or combination of that shown and other configurations. Moreover, in the area 15 of the board 6 near the foot end 16, where the extent of the board in the direction of the first transverse axis 12 and the second transverse axis 14 is more or less constant, the holes can be provided with edges which extend up over the surface 12. This will contribute towards an increase in the fixing of the pelt in the stretched position on the board 6, in that the leather side of the pelt in this area will be pressed down into the holes behind said edges by the fixing-bag, which will result in an improved retaining ability, whereby the leather side of the pelt is hooked fast but without this being damaged.

Figure 14:
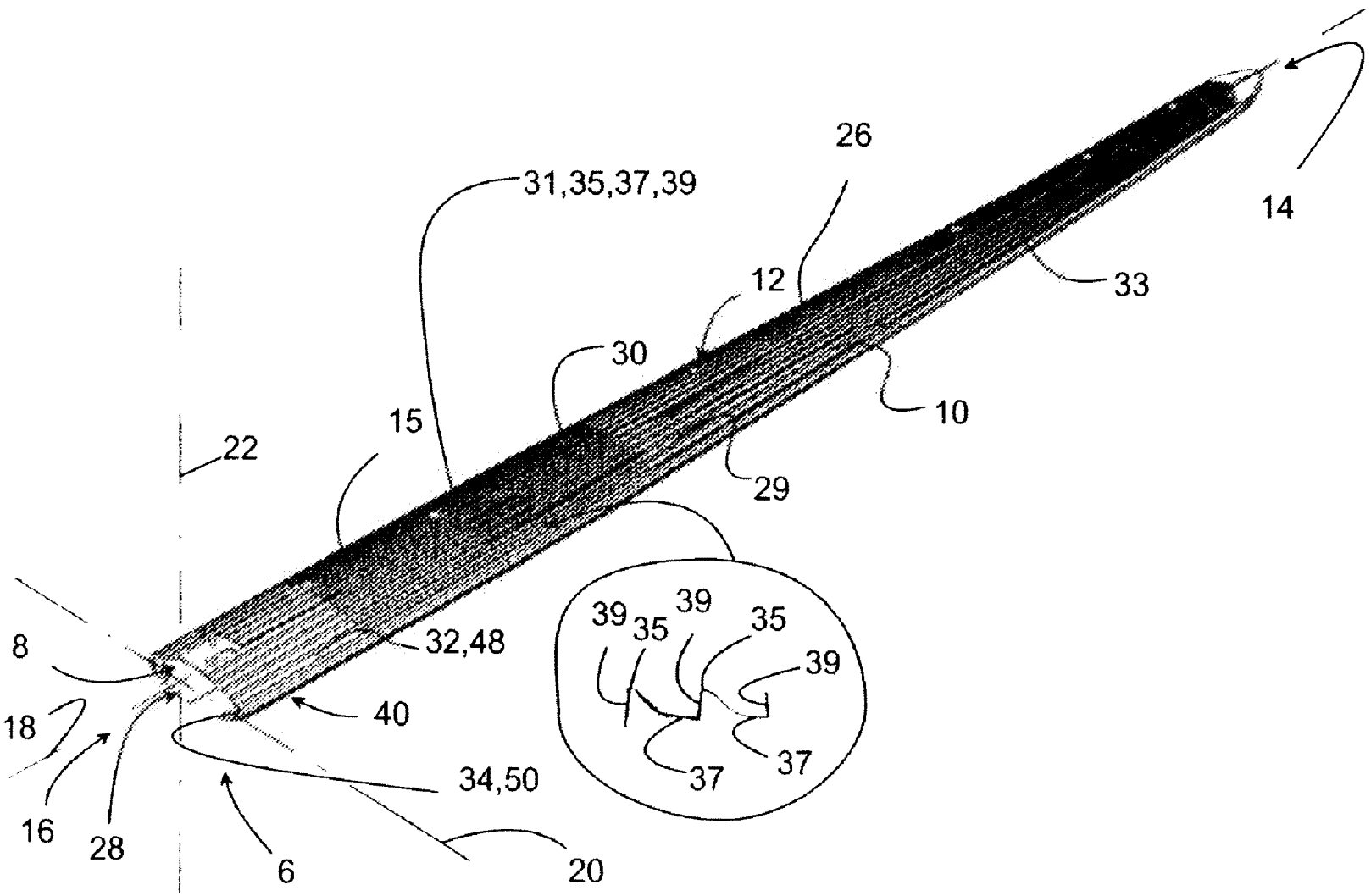
FIG. 14 is a perspective view of a third embodiment of the distension element/pelt board according to the invention.

As will appear from FIG. 14, the pelt board in this embodiment consists of similar half parts 32,34, which in the shown embodiment consist of half shells 48, 50 joined by locking means/assembly means 30, the subtending edges 36 of said half shells defining an envisaged first plane 38 which is substantially coincident with the first transverse axis (breadth axis) 20. The sides of the half shells facing away from each other extend in an arched manner and together constitute the surface 12 of the board 6, and also define a cavity 8 which via the holes 10 stands in connection with the surface 12. The half shells 48, 50 define a cavity 8, and the board 6 comprises an opening to the cavity 8 in the foot end 16.

Figure 5:
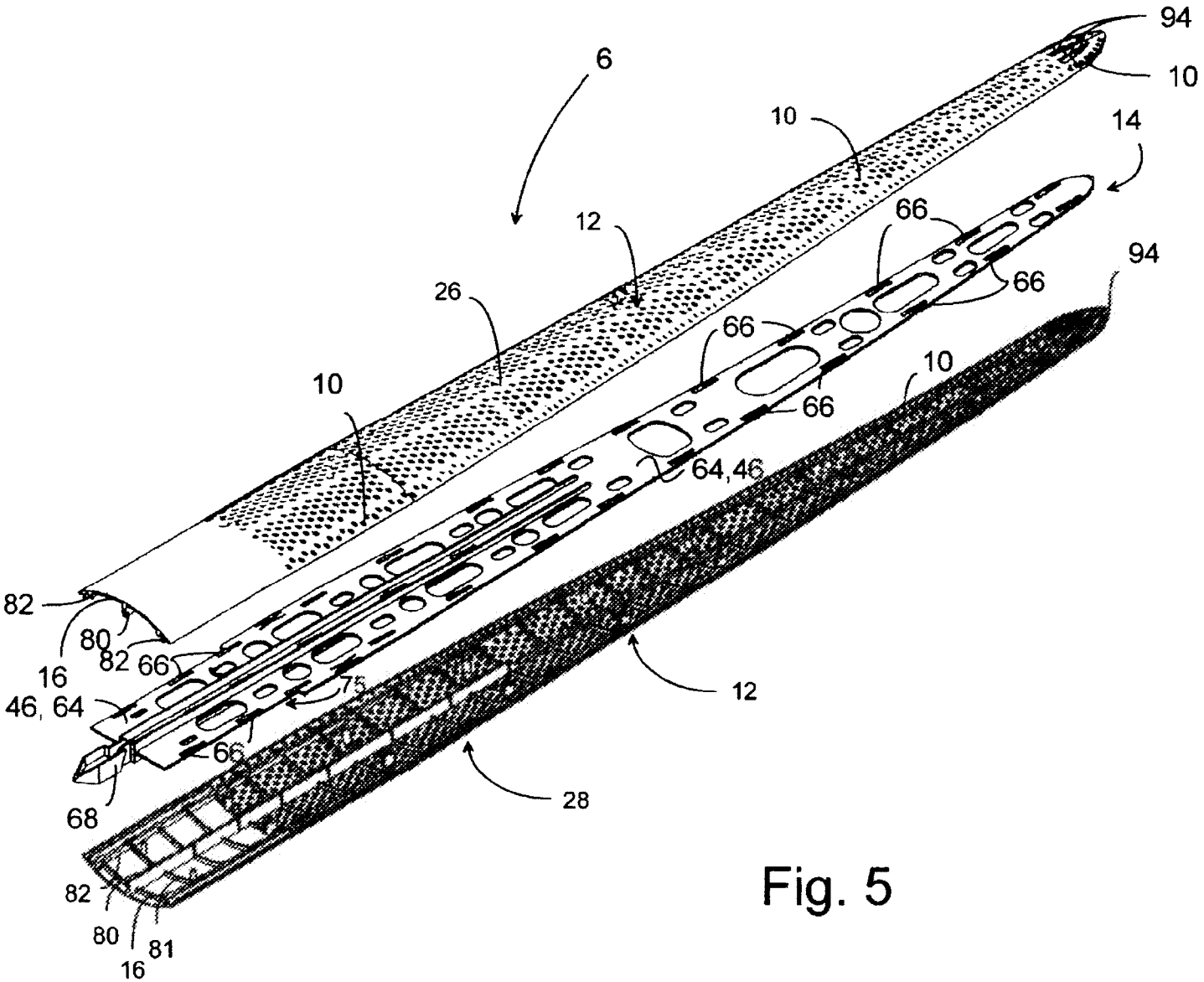
FIG. 5 is an exploded perspective view of the embodiment of the pelt board shown in FIG. 4.

As will further appear from FIG. 4, FIG. 5 and other figures, at the front end 14 the board 6 comprises slot-shaped openings 94 to ensure an effective and easy passage of air.

The embodiment of the board 6 shown in FIG. 4 is particularly suitable for use in the drying of pelts from furred animals, where the pelts are stretched and fixed in this position by means of a fixing-bag or similar fixing means which press at least a part of the leather side of the pelt in against the perforated surface 12. The drying takes place by effecting a continuous replacement of the air in the cavity 8, which e.g. can be done by blowing air in or sucking air out, whereby moisture from the leather side of the pelt is transported away in an effective manner. It has hitherto been unknown to effect the drying in this manner, where the drying air is held inside the cavity, where replacement of the air in the board's cavity takes place e.g. by blowing air in from the foot end 16 of the board, said air flowing out of the openings 94 at the front end 14 of the board. Trials with the drying of pelts with the use of the board 6 according to the invention have shown a considerable improvement and uniform drying of the leather side of the pelt, and in approx. ⅓ of the drying time involved with the use of the traditionally-known boards.

It shall further be mentioned that the front end 14 of the board 6 comprises means 96 for securing the nose end of a pelt stretched and held in this position on the board. The means consist of a sharp-edged area 96 along the edge of the pointed end 97, cf. FIG. 6, which are intended for the securing of the nose end of the pelt and contribute towards an effective securing of the pelt during the stretching and during the drying process.

The locking means/assembly means 30 which join the two half shells 48, 50 together are arranged so that the two half shells 48, 50 are relatively displaceable away from and towards the first plane 38, between a first outer position where a slot shaped opening 40 arises between the subtending sides 42,44 of the half parts, and a random position where said sides 42,44 can be in contact with each other.

Figure 6:
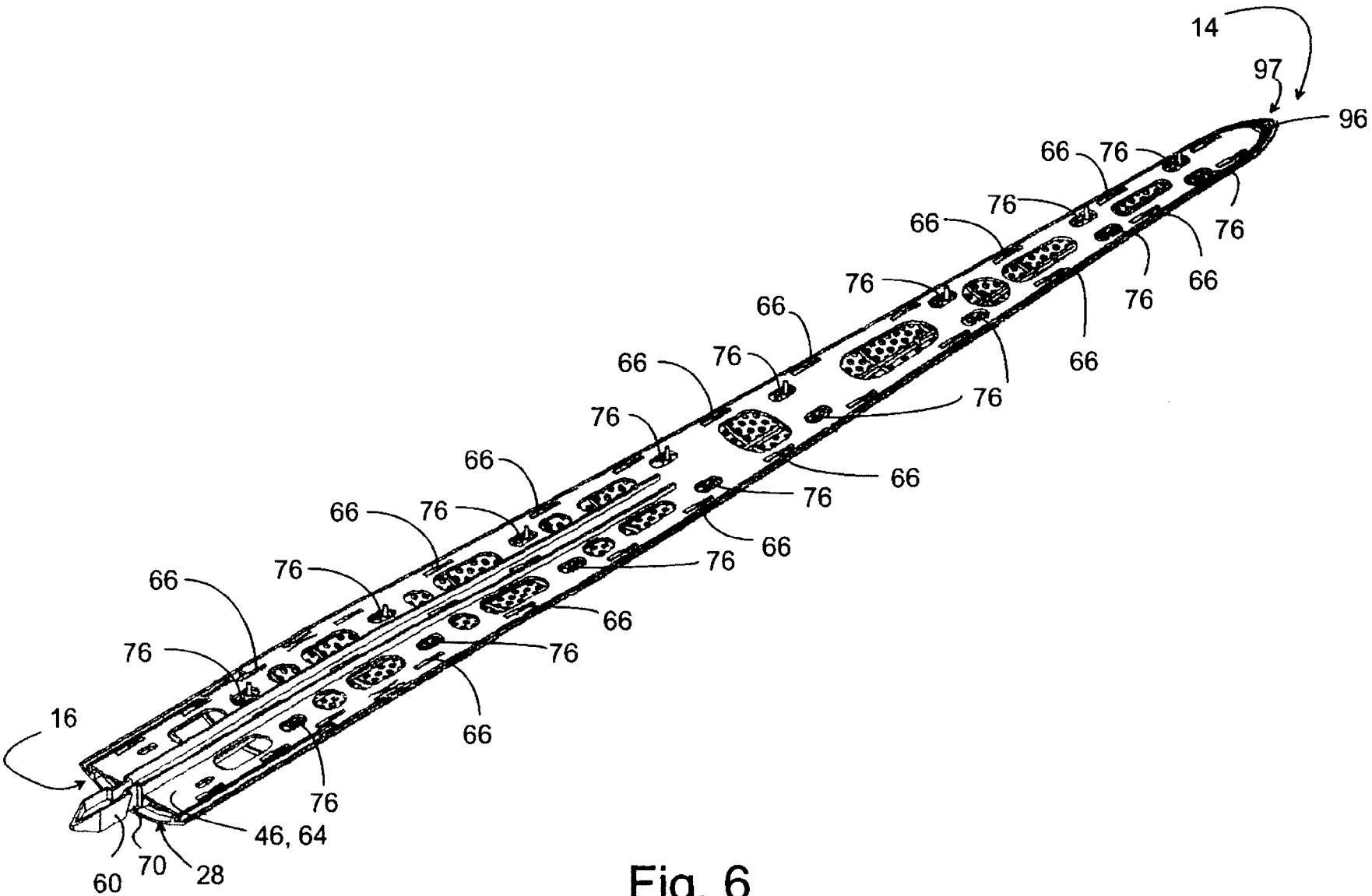
FIG. 6 is a perspective view of the pelt board shown in FIG. 4, where one half shell has been removed.

Between the half shells 48, 50 there is a wedge plate 64 which is displaceable in the longitudinal axis, as will appear from FIG. 5 and FIG. 6, and which comprises a part of the forcing means for the locking of the half shells 48, 50 in the first outer position. The remaining parts of the forcing means comprising studs 56 on the subtending sides 52, 54 of the half shells 48, 50 will be described later.

Figure 7:
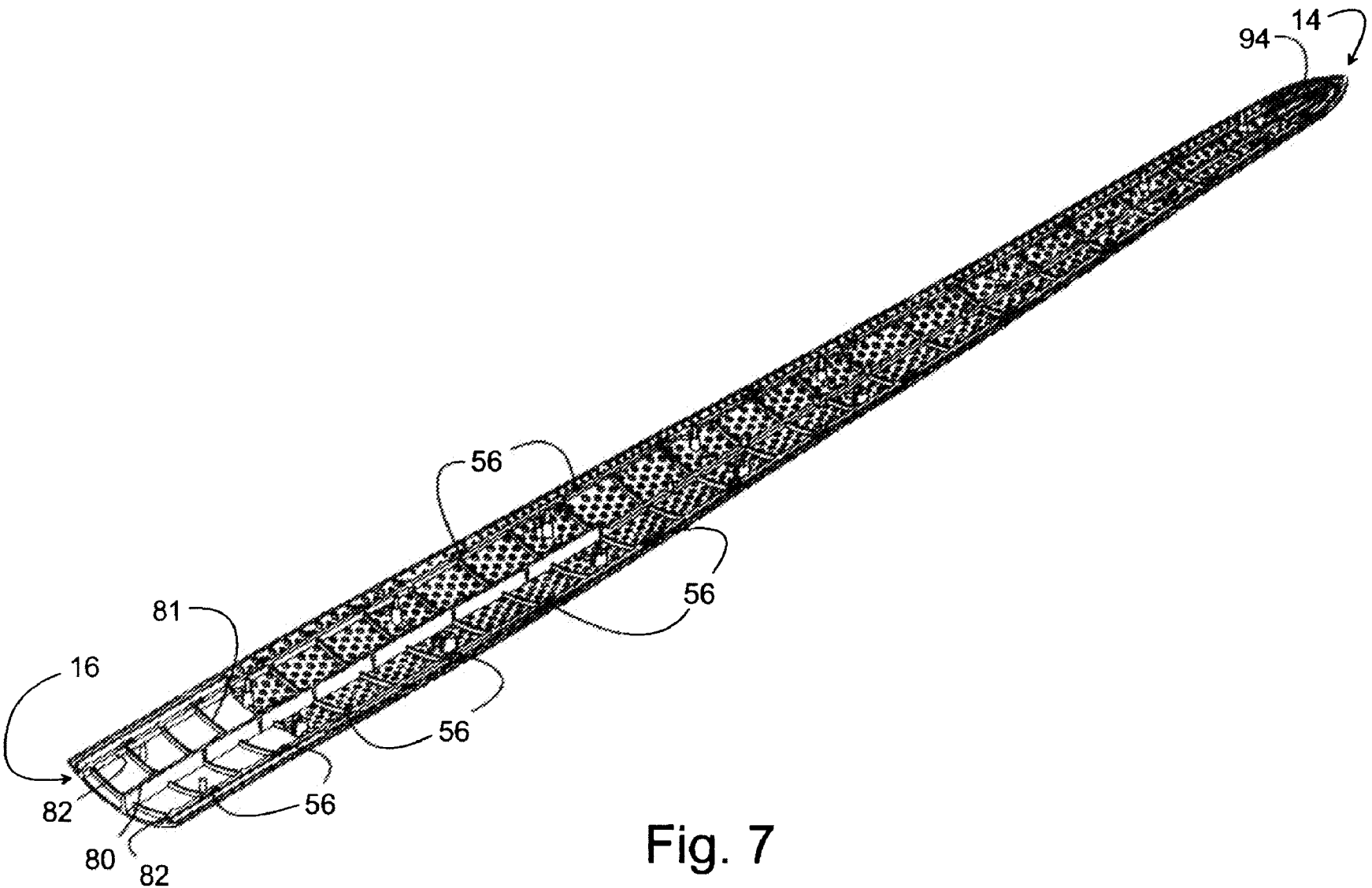
FIG. 7 is a perspective view of the inner side of a half shell of the embodiment of the pelt board shown in FIG. 4.
Figure 8:
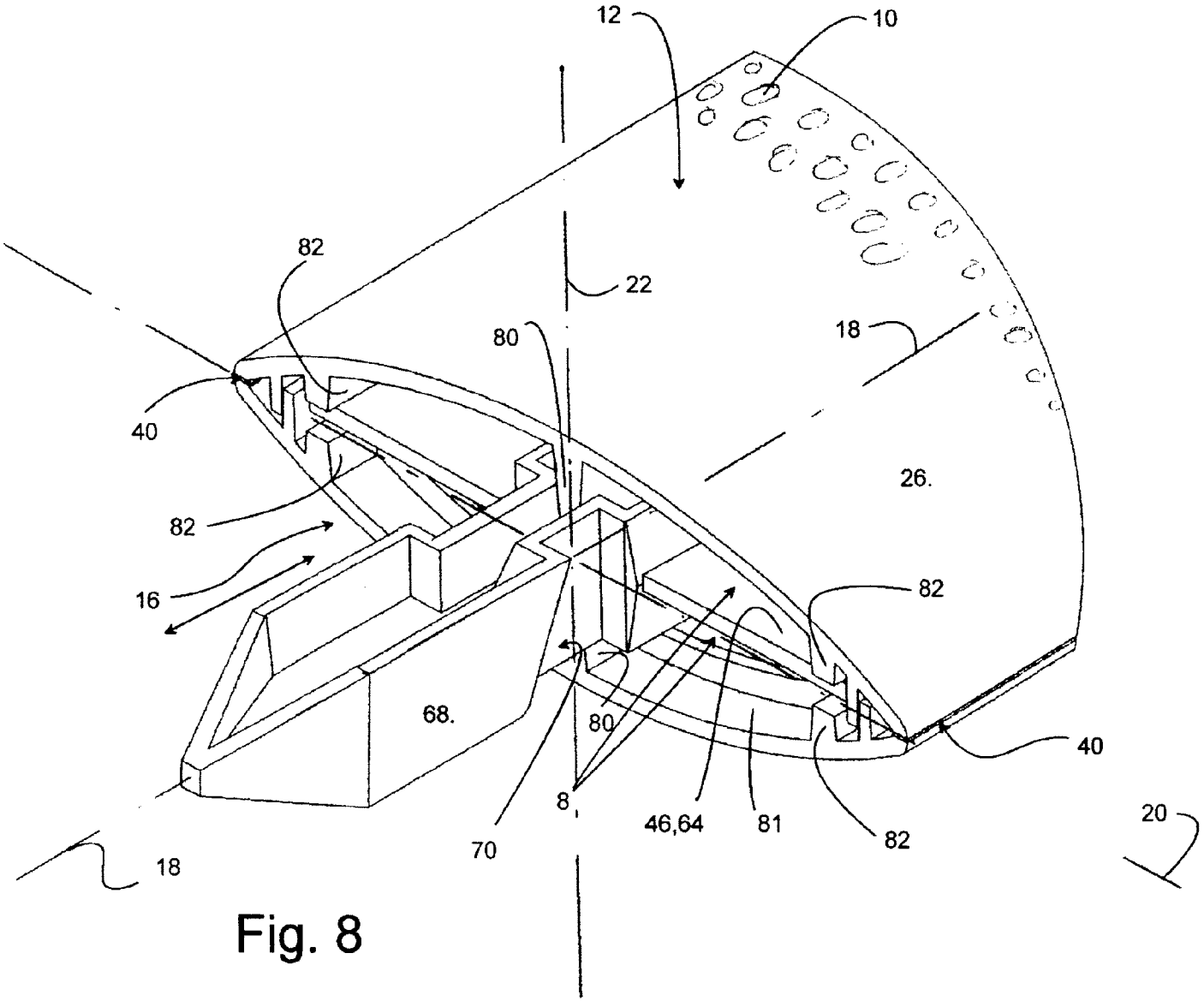
FIG. 8 is detail perspective view of the foot end of the embodiment of the pelt board shown in FIG. 4.
Figure 9:
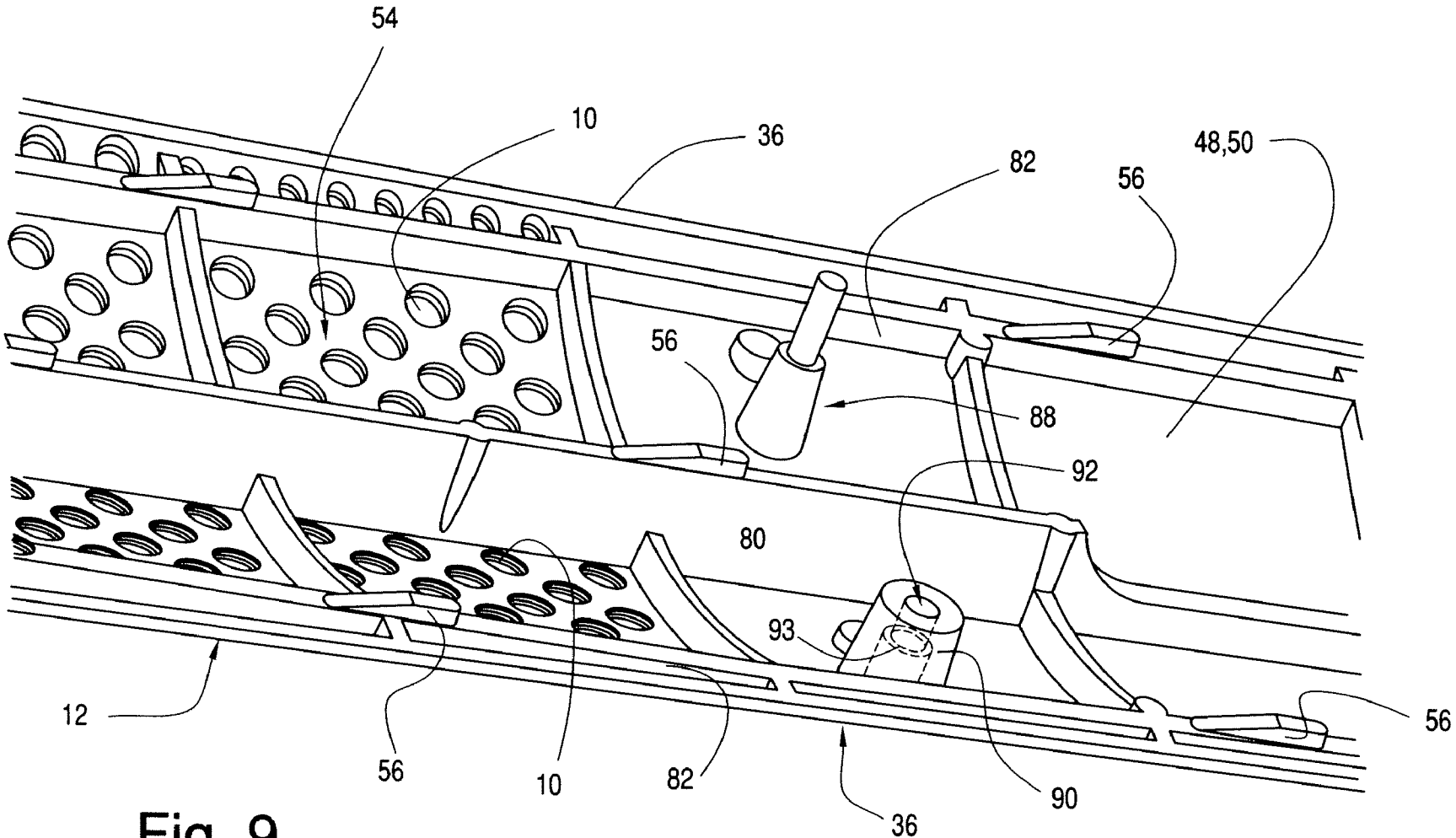
FIG. 9 is a detail section shown in perspective of the view in FIG. 7, showing the inner side of a half shell of the embodiment of the pelt board shown in FIG. 4.

As will appear from FIG. 7, FIG. 8 and FIG. 9, the subtending sides 52, 54 of the half shells 48, 40 comprise stiffeners 80, 82 which are arranged in the longitudinal direction and on which the displaceable wedge-plate rests. The half shells also comprise transverse stiffeners which stand in connection with the stiffeners 80, 82.

It shall be noted that the transverse stiffeners 81 will not have an impeding influence on the replacement of the air in the cavity 8, but possibly create turbulence in an air flow through the cavity 8, which will only improve the drying affect by the replacement of the air in the cavity. The stiffeners serve to stabilise the half shells, which will typically be made of plastic material or polystyrene.

The locking means 30 can consist of screws or similar means. Alternatively, the assembly can be effected as a click-assembly, where the locking means can consist of the cooperating elements 84, 86 projecting from the respective subtending sides 52, 54 of the half parts 48, 50, and which comprise projection 88 and projection 90 with openings 92 for receiving said projection 88. The geometry of the openings 92 and the projections 88 will mutually be fitted with locking means, so that after being pressed into the openings 92, the projections 88 are secured in a displaceable manner in the openings 92.

In a further embodiment, as indicated in FIG. 7, and which appears more clearly from FIG. 9, where at least the projections 88 consist of relatively light, fusible material, e.g., polystyrene or plastic, the openings 92 can alternatively consist of channels with a recess 93 opposite the subtending sides 52, 54 of the half shells 48, 50, where the diameter of the channels subsequently in the direction towards the surface 12 of the board 6 are larger. The joining of the similar half shells 48, 50 thus takes place by the insertion of a wedge-plate 64 in the first half shell 48, after which the second half shell 50 is placed on top of the first half shell with the projections 88 extending through suitable openings 76 in the wedge-plate 64, and further in through the openings 92, so that the free ends of the projections extend into the channels 92, past the recess 93, and with the wedge-plate in its active position, where a slot-shaped opening 40 arises between the subtending sides 42, 44 of the half parts, after which the free ends 88 are heated to melting point and pressed flat, after which the half shells 48, 50 are joined together. The disadvantage with this method of assembly is that the board 6 can not be separated, but which should neither be necessary for the lifetime of the board.

Figure 10:
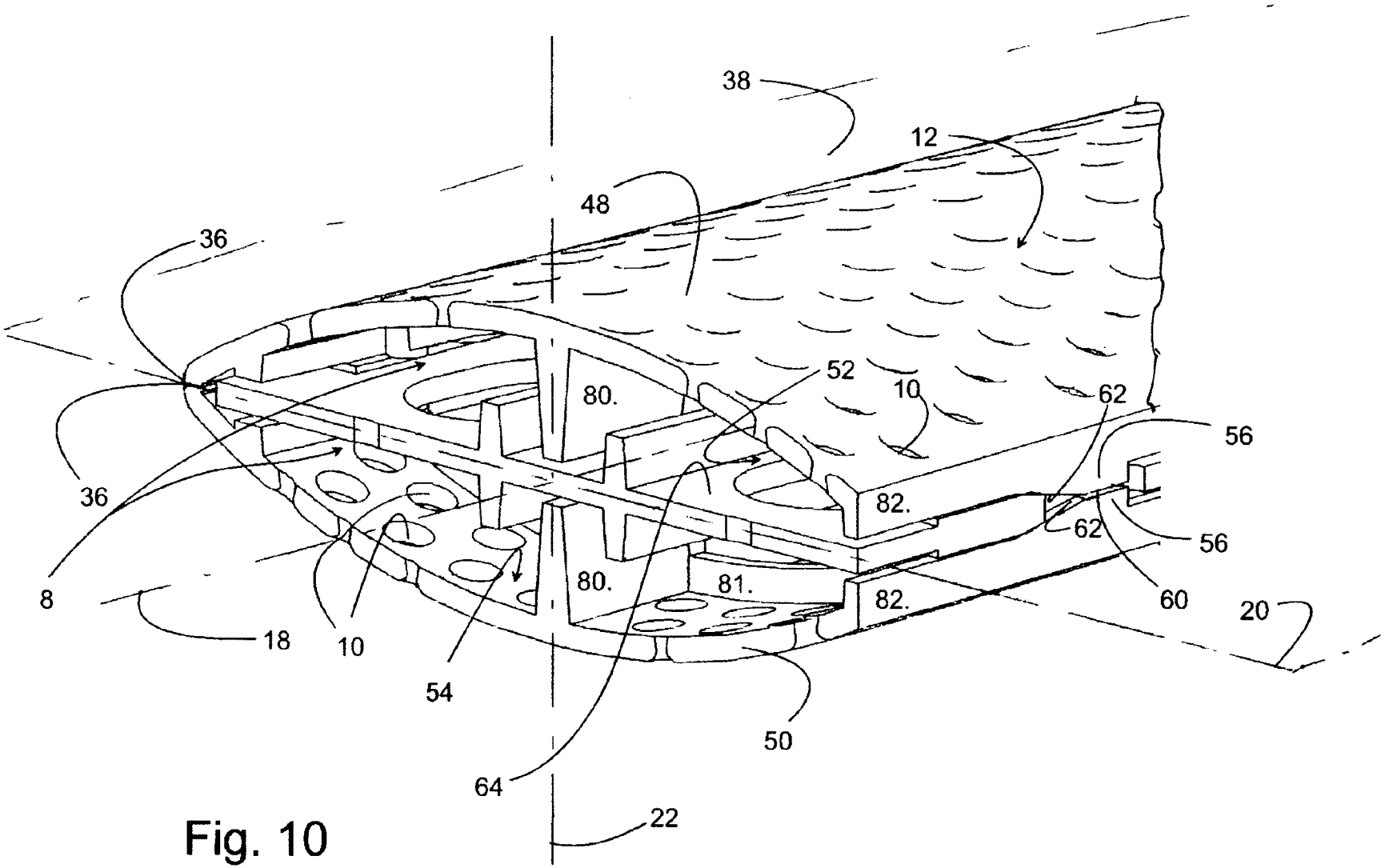
FIG. 10 is a view of the cross-section of the board shown in perspective.

The second part of the forcing means for the locking of the half shells 48, 50 in the first outer position, so that a slot-shaped opening 40 arises between the subtending sides 42, 44 of the half shells, or between the edges 36 of the half shells 48, 50, consist c.f. FIG. 10 of a plurality of studs 56 placed on the subtending sides 52, 54 of the half shells 48, 50, where from said sides there are a number of similar but laterally reversed studs 56 with freely extending ends 58 respectively comprising a plane side 60 and from here, sides 62 sloping in the direction towards the respective projections fixing area in the respective sides 52, 54 and towards the foot of the board 16, and where the plane sides terminate on a level near the first plane 38. In the embodiment shown in FIG. 4, FIG. 5, FIG. 7 and FIG. 9, the studs 56 are configured as projections on the stiffeners 80, 82.

As will appear from FIG. 5 and FIG. 6, the wedge-plate 64 displaceable in the longitudinal direction 18 between said half shells 50, 52 comprises wedge-shaped projections 66 on both, which cooperate with the sloping sides 62 of the studs 56 on the half shells 48, 50. With the displacing of the wedge-plate 64 in the direction of the front end 14 of the board 6, the wedge-shaped projections 66 will be moved in between the plane sides 50 of the studs 56, whereby the half shells 48, 50 are forced away from each other and the slot 40 between the edges will become broader, and the circumference of the board 6 becomes larger. With the retraction of the wedge-plate 64, the possibility will arise for a relative displacement of the half shells 48, 50 in the direction towards each other, or towards the plane 38, whereby the circumference of the board 6 will be reduced.

The advantage with the relatively displaceable arrangement of the half shells 48, 50, so that these are relatively displaceable towards and away from the plane 38, in combination with the wedge-plate 64, is quite considerable, in that it makes it possible to effect a reduction of the circumference of the board by retraction of the wedge-plate from the position where it is placed between the studs 56 to a position where the projections 66 are placed outside said studs 56, whereby the board 6 "collapses" slightly in the displacement of the half shells 48, 50 towards each other. Hereafter, it will be relatively easy to remove the pelt from the board after the drying process, simply by drawing the wedge-plate 64 back from the first position, where the board "collapses", and the reduction of the circumference of the board will result in the leather side of the pelt, which at the end of the drying process lies stretched against the surface, being released from said surface, for the reason that the structure around which the pelt tightly enfolds is now reduced in extent. Hereafter, it will be particularly easy to remove both the fixing means/fixing-bag and the dried pelt from the board 6.

As will appear from FIG. 4 and FIG. 8 and other figures, the wedge-plate 64 comprises a stubby, projecting element 68 which extends outside the foot end 16 of the board 6. It will be possible to displace the wedge-plate 64 by drawing the stubby element 68 in the direction away from the foot end 16 of the board.

However, with the invention it is realised that the carrying out of a manual displacement of the wedge-plate 64 will involve a lot of work, but it will still be easier to remove the pelt from the board 6 according to the invention. However, to achieve a more rational manner in which to carry out the retraction of the wedge-plate 64, it is realized that it is possible to effect the retraction of a plurality of wedge-plates at one time when the pelts on the distension elements/pelt boards 6 have been dried and are sitting in the drying aggregate 100 which cooperates with the board 6.

The stubby element 68 is intended to be introduced down in the cooperating first openings 112 in the drying aggregate 100 shown in FIG. 2, so that the board with the pelt is secured in the upright position on the upwardly-facing surface 110 of the drying aggregate with the foot end 16 in contact with the surface 110. As seen most clearly from FIG. 8, the stubby projecting element 68 also comprises a wedge shaped part 70 which is arranged in a substantially transverse manner to the longitudinal axis 18 of the board in the direction of the second transverse axis 22.

Precisely this wedge-shaped part 70 plays an important role in connection with the retraction of the wedge-plate 64.

As appears from FIG. 2, FIG. 11, FIG. 12 and FIG. 13, the drying aggregate 100 comprises an encapsulation 102 which defines a cavity 104, and an air replacement arrangement 106 for changing the air existing in the cavity 108, which in the shown embodiment consists of a blower unit 138. The encapsulation 102 comprises an upwardly-facing surface 110 with a number of first openings 112 and, under said surface 110, a number of substantially U-shaped profile rails 114 which are arranged in parallel and which have a bottom 116 comprising openings 118, the geometry and number of which correspond to the first openings 112. The openings 112, 118 cooperate with the projecting element 68 which extends outside the foot end 16 of a distension element/pelt board. This enables at least one, preferably a plurality of distension elements/pelt boards 6 to be placed standing upright from the upwardly-facing surface 110 with the foot end 16 of the board in contact with the upwardly-facing surface 110. The upwardly-facing surface 110 also comprises further openings 120, 120' near the respective first openings 112 lying within the limit of the foot ends 16 of the respective boards, so that the further openings 120, 120' stand in connection with the cavities 8 in the respective distension elements/pelt boards 6 which are placed in the upwardly facing surface 110, so that the air in the cavity 8 of a distension element/pelt board 6 which is placed in the upwardly-facing surface 110 is changed by replacement of the air in the cavity 101 by the air replacement arrangement 106/blower unit 138.

As also appears, the first openings 112 and the further openings 120, 120' are arranged in parallel rows in the upwardly-facing surface 110. In the cavity 108, under said surface 110, in slots 122 in the ribs 124, 126 of the U-shaped profile rails 114, there are displaceable drawplates 128 arranged in parallel with the upwardly-facing surface 110. The drawplates 128 have similarly-shaped through going cut-outs 130 for engaging the projection element 68 which extends outside the foot end 16 of a distension element/pelt board 6, and where each through-going cut-out 130 comprises a projection 132 which cooperates with the wedge-shaped part 70 on the projecting element 68 which is arranged in a substantially transverse manner to the longitudinal axis 18 of the board.

Figure 12:
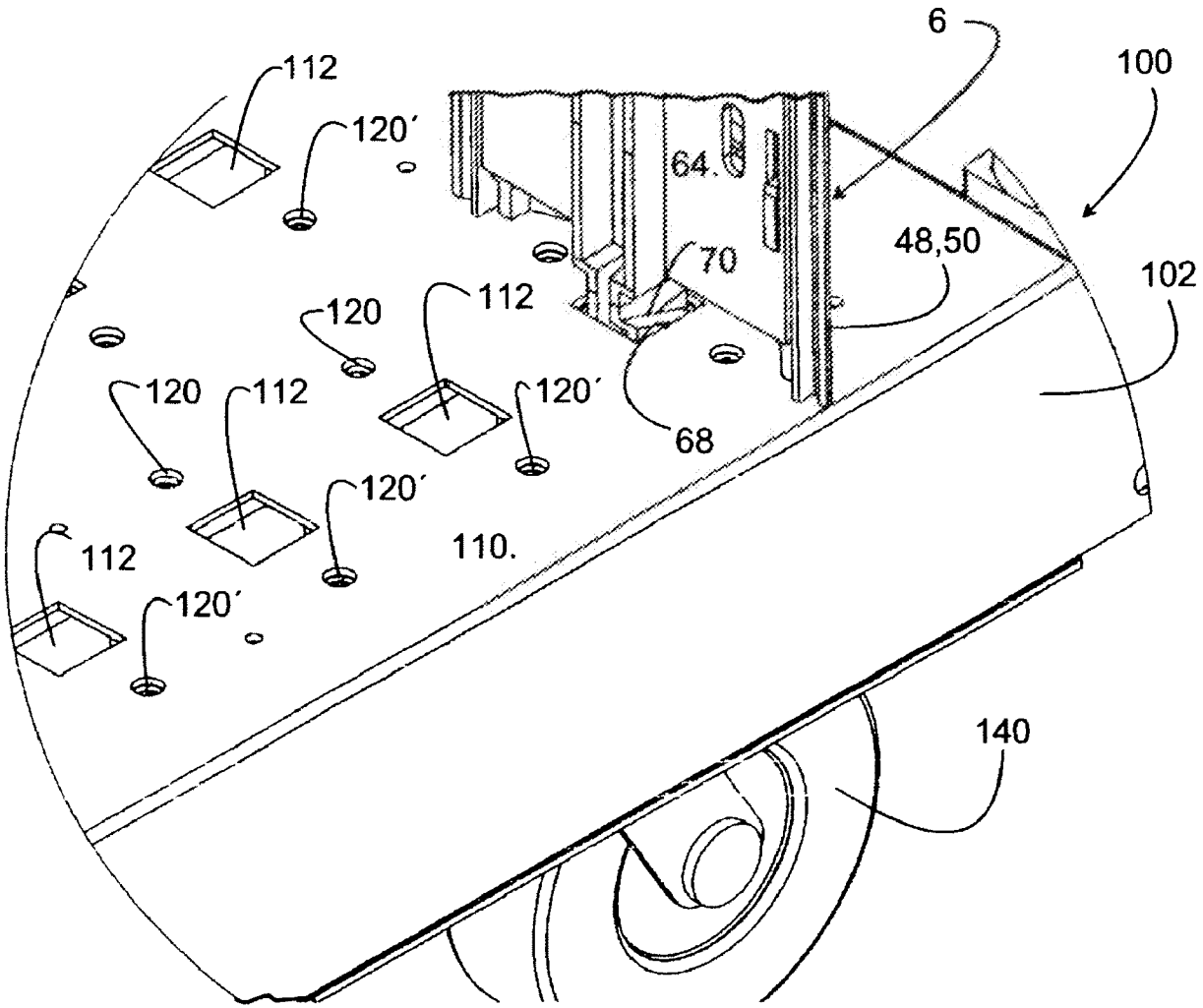
FIG. 12 is a detail perspective view of a section of the drying aggregate with cabinet.
Figure 13:
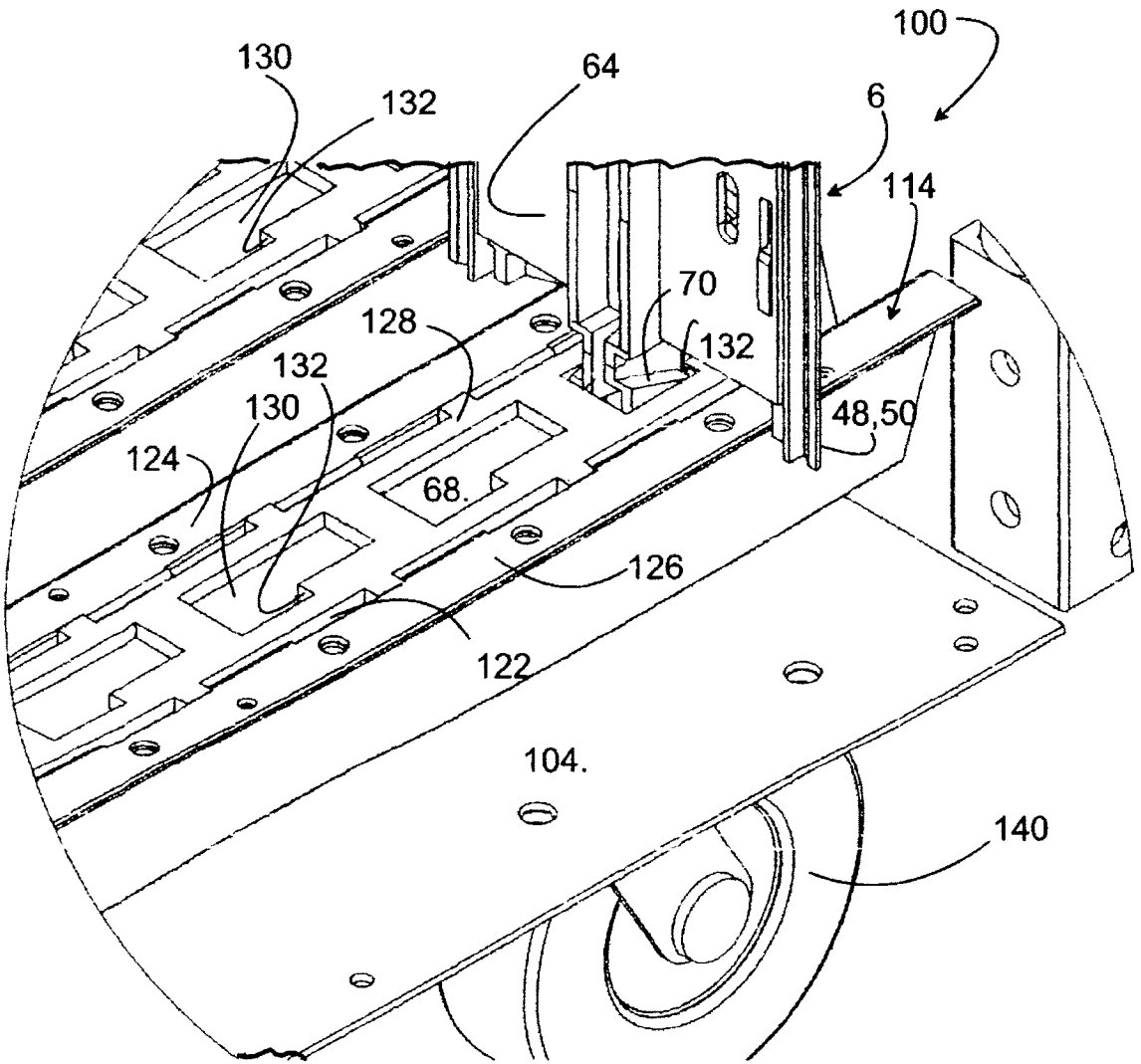
FIG. 13 is a detail perspective view of a section of the drying aggregate without cabinet.

As will appear from FIG. 12 and FIG. 13, a displacement of a drawplate 128 between a first outer position where the projections 132 are not in engagement with the wedge-shaped part 70, to a second outer position where the projections 132 are in engagement with the wedge-shaped part 70, will result in a displacement of the forcing means/the plate-shaped element (wedge-plate) 46/64, so that the wedge-shaped projection 66 on the plate-shaped element is moved to a position away from the plane surfaces 60 of the studs 56, whereby the subtending sides 52, 54 of the half shells 32,34, 48, 50 are moved to a position where the subtending sides 52, 54/edges 36 are lying closer to each other.

This means that a displacement of a drawplate 128 will result in a displacement of the wedge-plate 64 in all of the distension elements/pelt boards 6 which are placed in the relevant rows, which is a considerable simplification of this work as compared to carrying out displacement of each individual plate in the respective distension elements/pelt boards 6.

Figure 11:
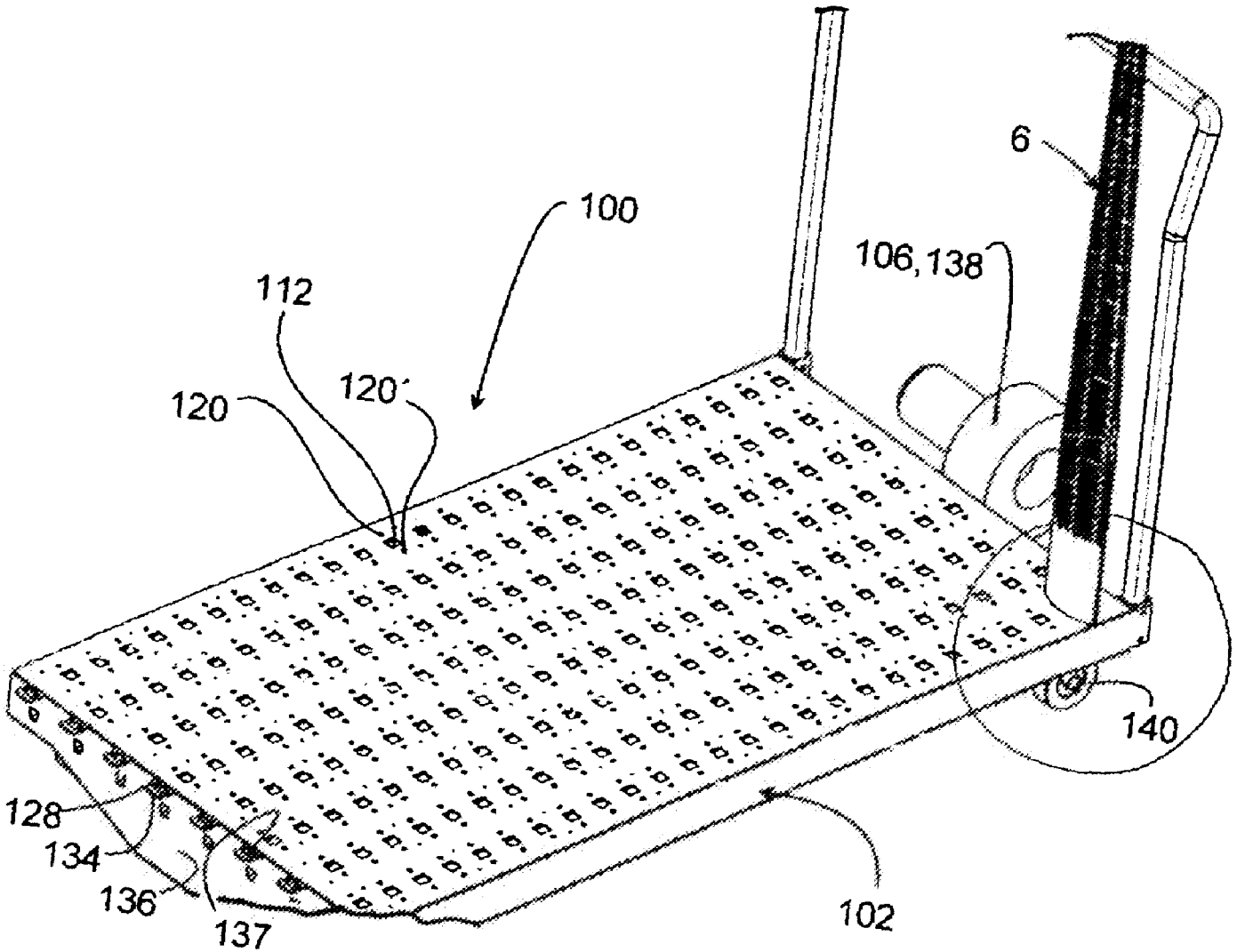
FIG. 11 is a perspective view of the system for the drying of pelts according to the invention.

In the embodiment of the drying aggregate 100 according to the invention shown in FIG. 11, the drawplates 128 comprise parts 134 freely extending through a side 136 of the encapsulation 102. These extending parts 134 comprise through-going openings 137 for cooperating operation with not-shown traction facilities for displacement of the draw-plates 128.

As shown in the figure, the drying aggregate 100 can be made mobile by placing it on wheels 140, whereby a considerable saving is achieved in the handling and transport of the dried pelts from the place where the pelts are mounted on the boards, and to the place where the drying of the pelts is carried out. It can further be mentioned that the air replacement arrangement 106 for changing the air in the cavity 108 in the encapsulation 102 can alternatively consist of a suction unit which in a manner similar to that of the blower unit 138 can be integrated with the encapsulation 102.

Figure 15:
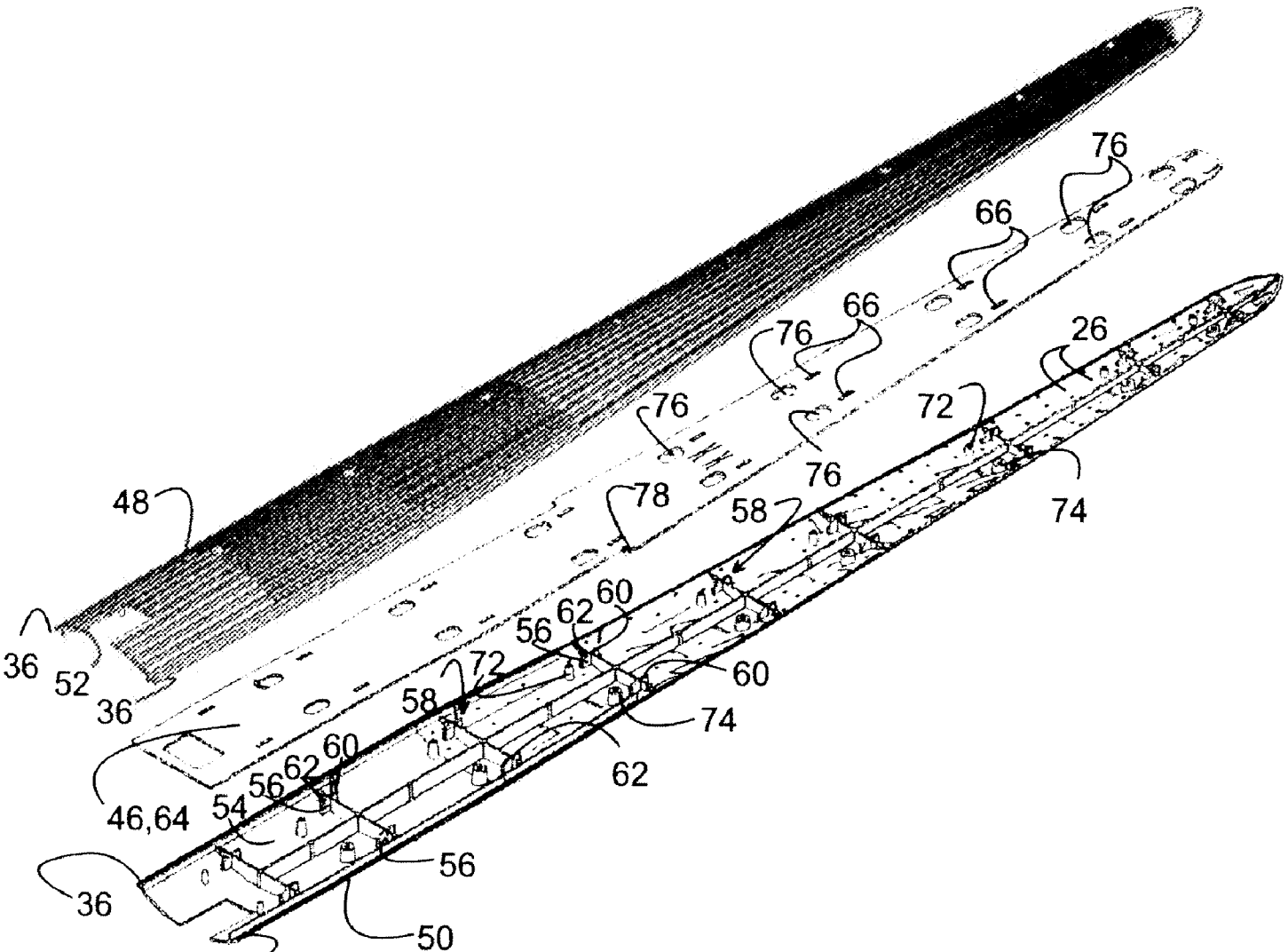
FIG. 15 is an exploded view of the distension element/pelt board shown in FIG. 14.

It shall further be mentioned that the board 6 can be configured with other embodiments of the surface 12. In FIG. 14 and FIG. 15 there is thus shown a third embodiment of the pelt board according to the invention, where a part of the surface has a longitudinal grooving 29 with the grooves arranged substantially parallel with the longitudinal axis 18 of the board. The distension element/pelt board 6 shown in FIG. 14 and FIG. 15 further comprises in relation to the longitudinal grooving 29 second transverse grooving/serrations 31, the extent of which, as shown in FIG. 14 and FIG. 15, is limited to a part of the area 15 of the board 6 closest to the foot end 16, and at a distance from the foot end 16, where the extent of this in the direction of the first transverse axis 20 and the second transverse axis 22 is more or less constant, to and including a part of the area 33 where the extent of the board in relation to the longitudinal axis 18 in the direction of the first transverse axis 20 and the second transverse axis 22 is more or less decreasing in the direction towards the front end 14. The bottom of the longitudinal grooving 29 stands via holes 10 in connection with the cavity 8 which is defined by the two half shells 48, 50, which together with the wedge-plate 64 constitute the pelt board 6. The transverse grooving/serrations 31 are necessary here in order to be able to secure the pelt stretched out on the board by means of a fixing bag, for the reason that the leather side of the pelt in this embodiment is not pressed into the holes in the surface 12 of the pelt board 6.

Figure 16:
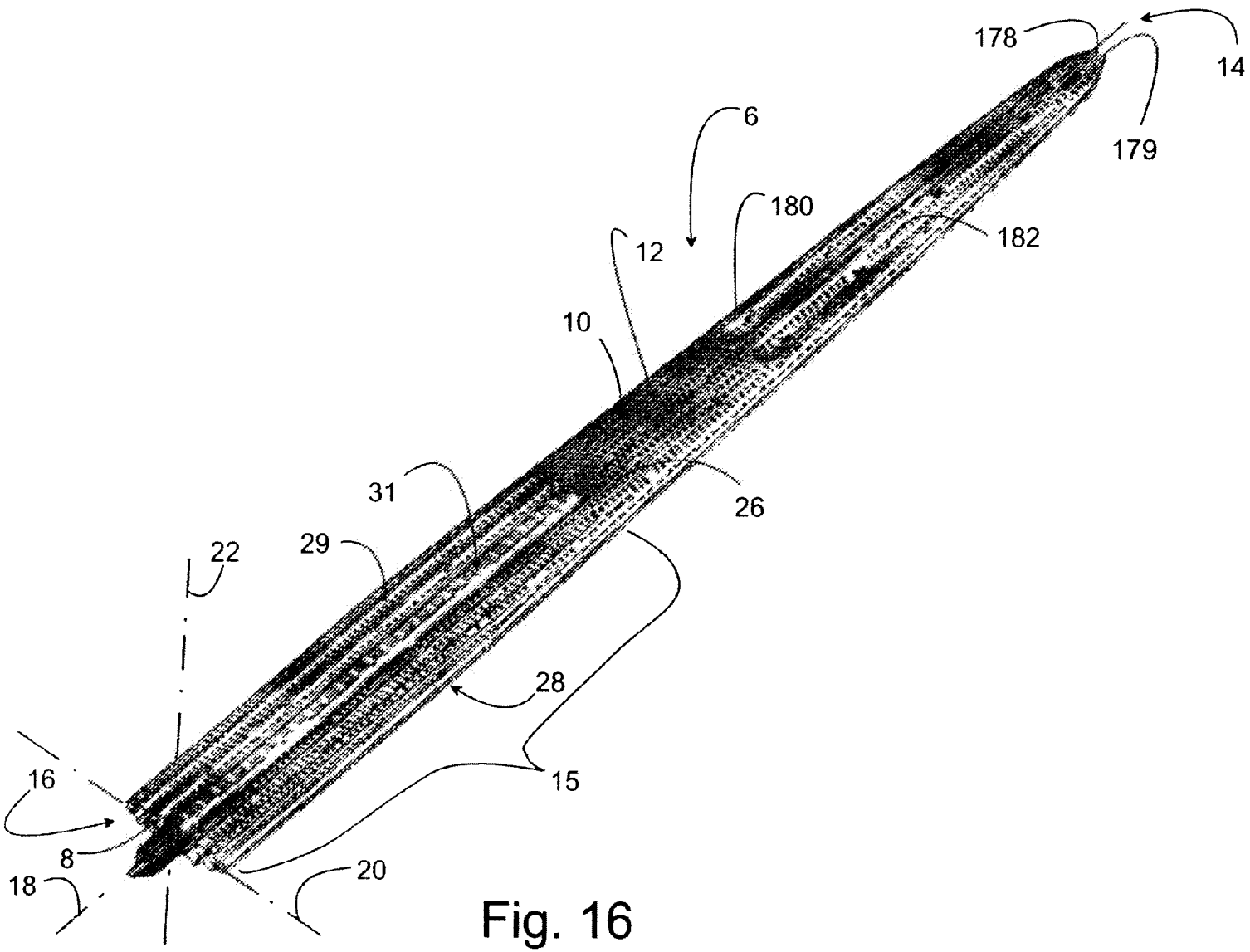
FIG. 16 is a perspective view of a fourth embodiment of the distension element/pelt board according to the invention.

In FIG. 16 there is shown a further and fourth embodiment of the pelt board 6 according to the invention. As indicated in the figure, but which appears more clearly in FIG. 17 and FIG. 18, this comprises the longitudinal grooving 29 in the board's lower end in the area 15, and also a transverse corrugation 31 to provide a good counter-hold on the leather side of the pelt, which is pressed against the board 6 by a fixing-bag (not shown) while it is stretched and secured in this position during the drying process. As further appears clearly from FIG. 18, which is an exploded end view of the pelt board 6, seen from the foot end 16, the half shells 48, 50 extend in an arched manner in combination with the grooving 29.

Figure 17:
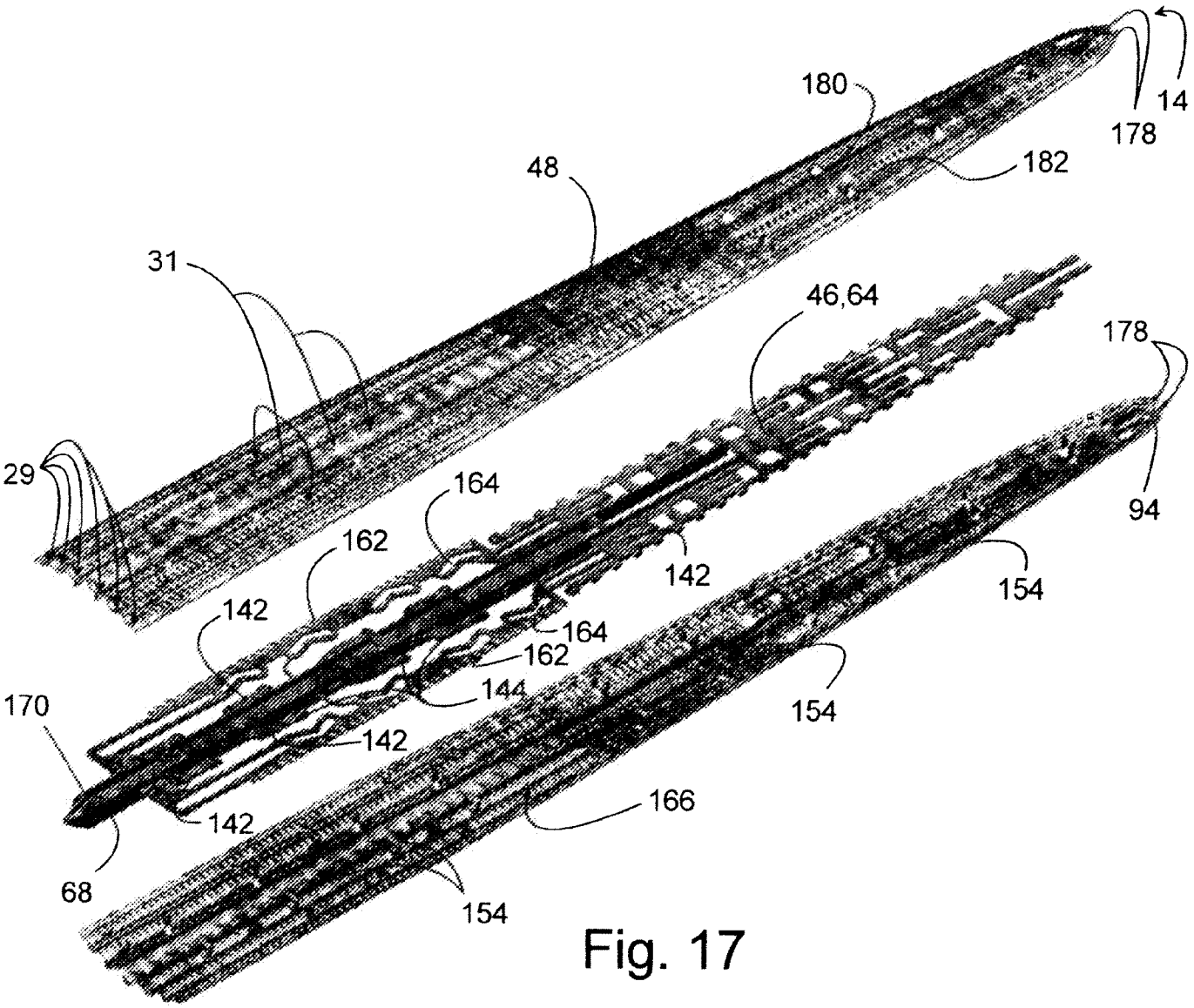
FIG. 17 shows an exploded view of the embodiment of the distension element/pelt board shown in FIG. 16.
Figure 18:
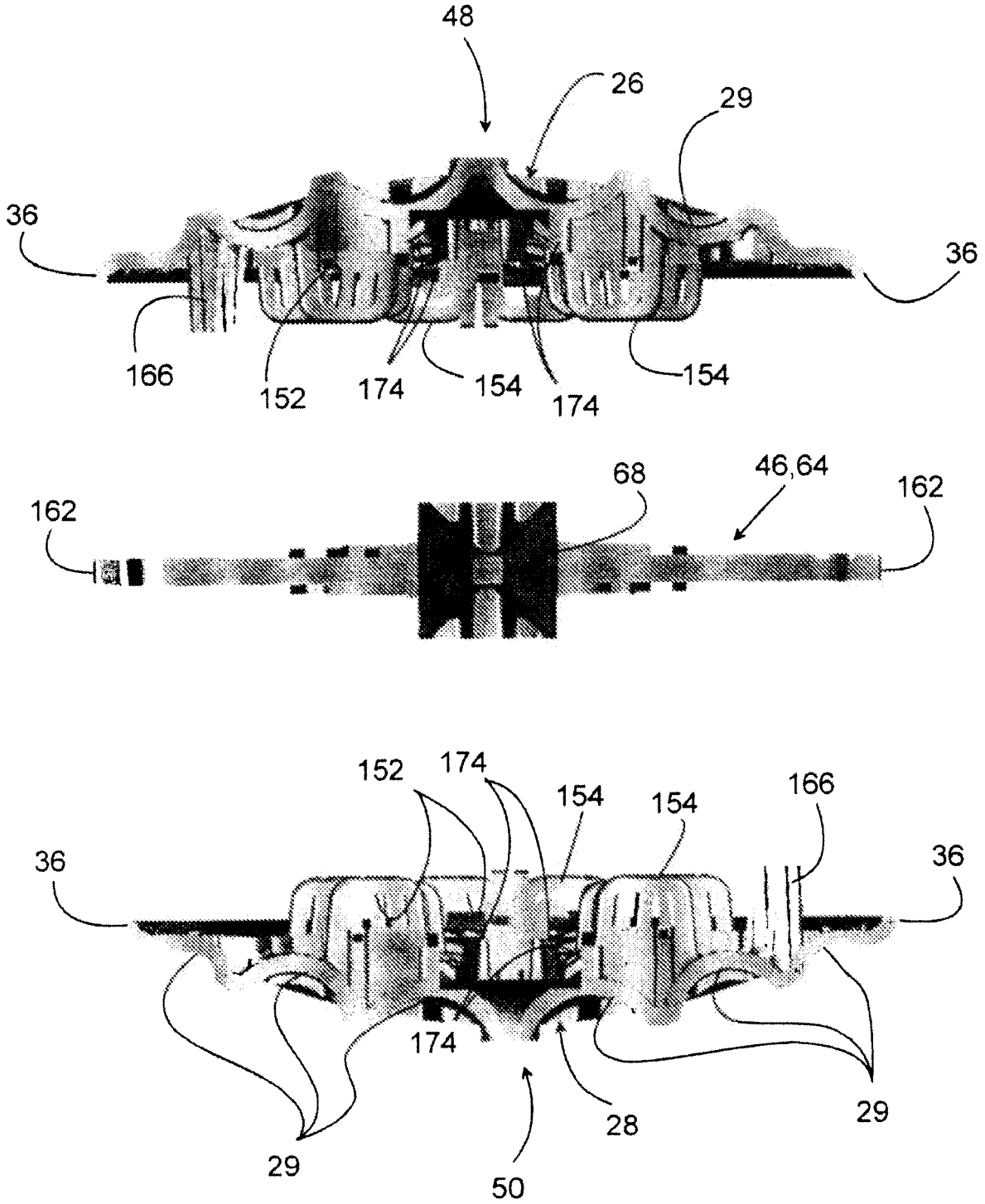
FIG. 18 shows an end view of the distension element/pelt board shown in FIGS. 16 and 17, seen from the foot of the board.
Figure 19:
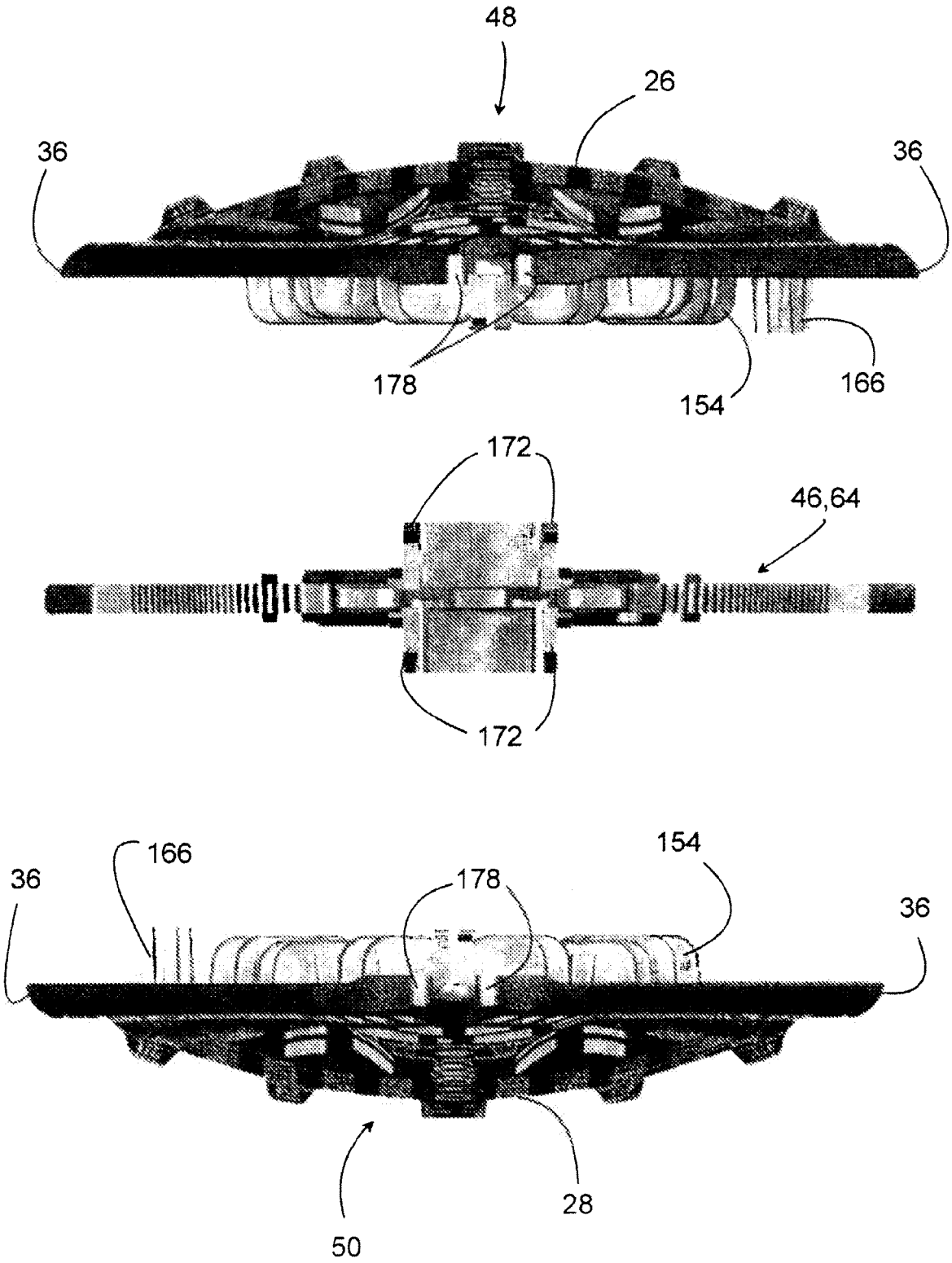
FIG. 19 shows an end view of the distension element/pelt board shown in FIGS. 16 and 17, seen from the pointed end of the board
Figure 21:
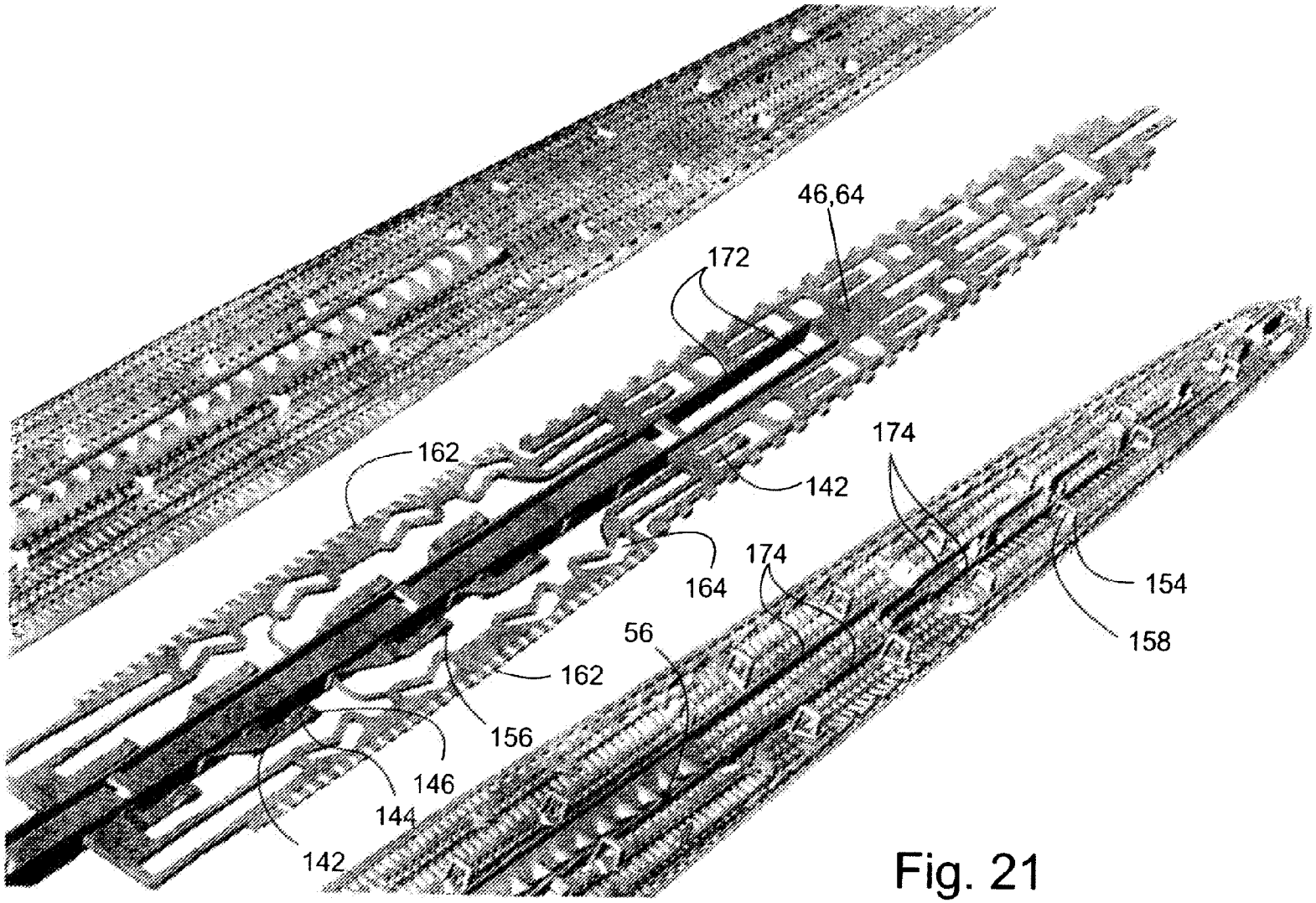
FIG. 21 shows an exploded detail section of the embodiment of the distension element/pelt board shown in FIGS. 16-20.

In this embodiment, as shown most clearly in FIG. 16 and FIG. 17, and to some degree also in FIG. 21, in the half part of the board nearest the pointed end 14, the distension element/pelt board 6 comprises recesses 180, 182 extending in parallel in the half shells 48, 50, which serve to reduce the compression of the pelt during the drying process in the area where the front paws are placed, where in this area the pelt lies in three layers, which with the use of the traditionally-known pelt boards makes it extremely difficult to carry out an effective drying of this area of the pelt, which hereby entails the risk of the pelt being given the earlier mentioned "black spots". The existence of the recesses enables the drying to be carried out in a more effective manner, in that the layers of the pelt in the area of the paws are not pressed against each other.

Figure 20:
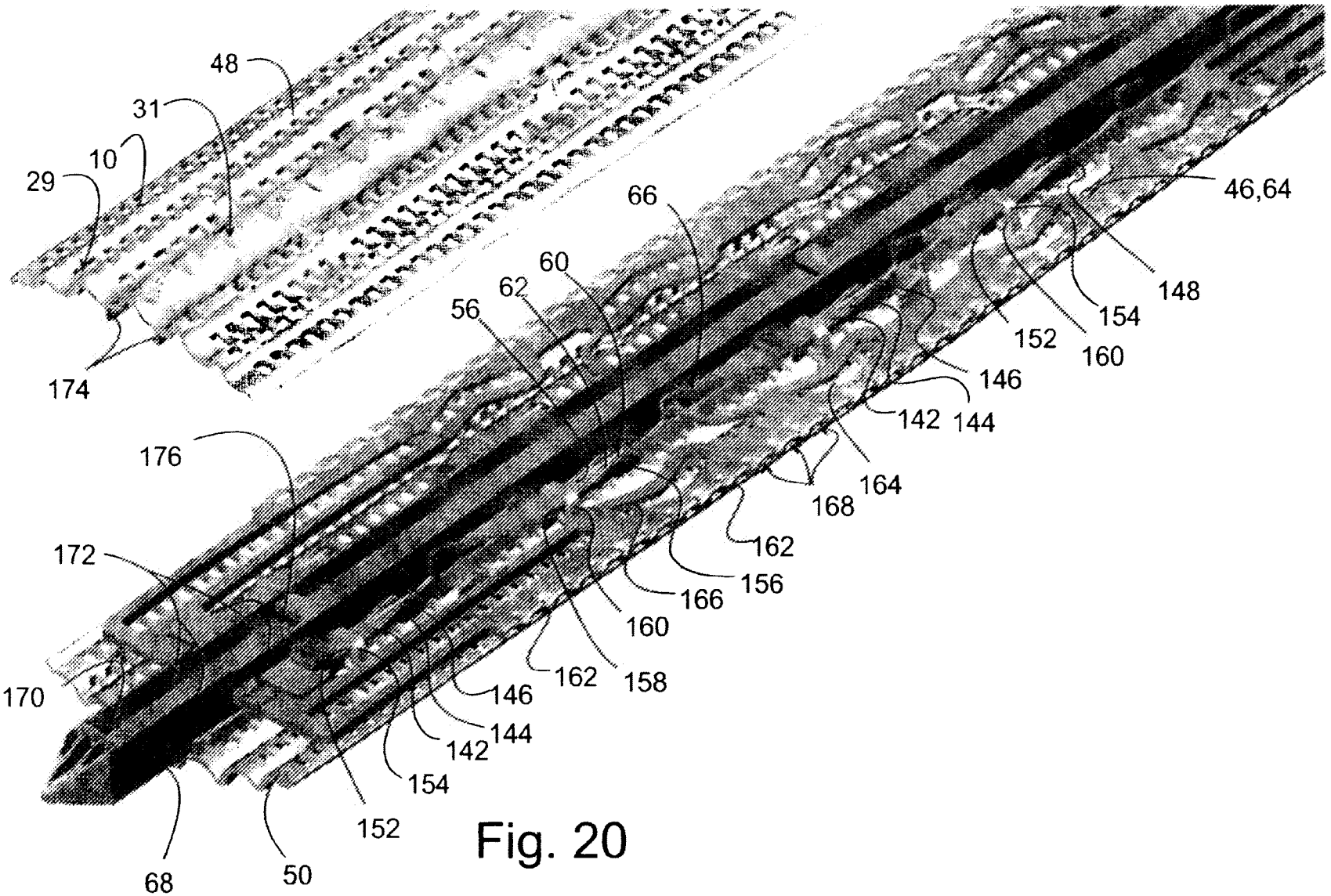
FIG. 20 shows a detail section of the lower end of the board, with the one half shell raised.

As shown in FIG. 20, the plate-shaped elements 46, 64 have a very open structure, and comprise the earlier-discussed studs 56 with plane sides 60 and sloping surfaces 62, which cooperate with wedge-shaped projection 66 on the plate shaped elements 46, 64 to effect a relative displacement of the half shells 48, 50 of the board away from each other, i.e. by displacement of the plate-shaped elements 46, 64 to the first advanced position.

As further appears from FIG. 17, FIG. 18, FIG. 20 and FIG. 21, the pelt board also comprises means for the force-controlling of the half shells 48, 50 in the direction towards each other by displacement of the plate-shaped elements 46, 64 in the direction of the board's foot end 16 to the second outer position.

Said means consist of tongues 142 on the plate-shaped element 64, said tongues 142 having inclined wedge surfaces 144 which, from a plane surface 146 nearest to the free ends 148 of the tongues, decrease in the direction towards the tongues' starting points 150, said inclined surfaces wedge surfaces 144 and plane surfaces 146 cooperating with side surfaces 152 in bridges 154 on the subtending sides of the half shells 48, 50, into which bridges 154 the tongues 142 are introduced in the assembly of the distension element/pelt board 6. With the retraction of the plate shaped elements 46, 64, the wedge surfaces 144 are moved to a position in the openings 158 in the bridges 154, which will result in a displacement of the half shells in the direction of the board's centre axis 18.

In the shown embodiment, the tongues 142 have a further function, i.e. as fixing and assembly elements, where the free ends 148 of the tongues further comprise a projection 156 (FIG. 20) which, in the assembly of the pelt board 6, which comprises a first half shell 48 and a second half shell 50 consisting of similarly shaped laterally reversed elements, and the plate-shaped element 64, is used to secure said parts in connection with each other after assembly of the board 6.

This is done by the free ends 148 of the tongues 142 being brought into a start position between said two half shells 48, 50, with the free ends 148 of the tongues 142 placed opposite the pair-wise subtending bridges 154 on the two half shells 48, 50, after which there is effected a relative displacement respectively between the two half shells 48, 50 on the one side and the plate-shaped elements 46, 64 towards each other, whereby the free ends of the tongues are displaced from the start position in the direction towards the front end 14 of the half shells 48, 50, by which movement the tongues 142 and herewith the projections 156 are moved to a displaceable but partly locked position behind a bridge side 160 facing away in relation to a tongue's starting point 150, whereby the plate-shaped elements 64 alone will subsequently be able to displaced between the outer positions.

In the shown embodiment, however, the distension element/pelt board 6 comprises a further facility which prevents the leather side of the pelt in the fixing area of the board, where the fixing-bag presses the pelt against the surface, from being forced into the slot-shaped opening 40 between the subtending side edges 36 of the half shells 48, 50. This facility consists in the plate-shaped elements 64, along a part of the side edges 162, further comprising V-shaped tracks 164 for engagement of guide pins 166 projecting from the subtending sides 52, 54 of the first half shell 48 and the second half shell 50 respectively. It is hereby achieved that by displacement of the plate-shaped elements 54 to the advanced position, the said side edges 162 are moved in the lateral direction away from the longitudinal axis 18 to a position the side edges 162, which fill out the slot-shaped opening 40 between the edges 36 of the half shells 48, 50, whereby in the distended condition of the distension element/pelt board they constitute a part of the outer surface of the board. The side edges 162 hereby block the forcing of the leather side of the pelt into said slot-shaped opening 40 between the half shells 48, 50, which is of great significance in connection with the removal of the pelt from the board, where it will be very unlucky should the leather side of the pelt be clamped between said edges 36 of the half shells 48, 50. With the view of ensuring an effective drying of the leather side of the pelt in the areas around the extent of the side edges, the side edges 162 are configured with corrugations, so that between these and the edges 36 of the subtending sides 52, 54 of the half shells 48, 50, channels 168 are formed which stand in connection with the cavity 8 defined by the half shells 48, 50.

In the shown embodiment, it is further preferred that the displacement of the side edges 162 is limited to the extent where that part of the plate-shaped element 64, where the side edges which comprise the V-shaped tracks 164, preferably extends between the foot end 16, and at a distance from the foot end 18, where the extent of the board in the direction of the first transverse axis 20 and the second transverse axis 22 is more or less constant, to and including a part of the area 33 where the extent of the board in relation to the longitudinal axis 18 in the direction of the first transverse axis 20 and the second transverse axis 22 is more or less evenly decreasing in the direction towards the front end 14.

In the embodiment of the pelt board shown in FIG. 16-21, the stubby projecting element 68 comprises counter-holding surfaces 170 which are intended for engagement with means which displace the plate-shaped elements 46, 64 between the outer positions.

The stubby projecting element 68 further comprises projecting ribs 172 extending in parallel with the longitudinal axis 18, and arranged parallel with the second transverse axis 22 (the height axis), said ribs further extending over a part of the plate-shaped element 64. Said ribs 172 cooperate with longitudinal ribs 174 which stand out from the subtending sides 52, 54 of the half shells 48, 50, and which extend parallel with the ribs 172, where by their mutual positioning and extent the ribs 172, 174 form a channel 176 for blowing drying air into or sucking drying air out of the board's cavity 8. This construction hereby makes it possible for the drying air to be led in via the channel 176, and enables the air to be distributed a distance inside the board, whereby a considerably better utilisation of the blown-in air is achieved, and herewith a more effective drying. It is namely in the area around the front paws of the pelt, where it is difficult to effect a drying of the leather side of the pelt, that the existence of the channels has proved to be even more valuable, in that the drying air is dispersed in precisely this area.

Therefore, it is preferred that the ribs 172 extend between the foot end 16, and at a distance from the foot end 18, where the extent of the board in the direction of the first transverse axis 20 and the second transverse axis 22 is more or less constant, to and including a part of the area 33 where the extent of the board in relation to the longitudinal axis 18 in the direction of the first transverse axis 20 and the second transverse axis 22 is more or less evenly decreasing in the direction towards the front end 14.

Moreover, by establishing a contraction of the channel by reducing the distance between the ribs 174 and the subtending sides 52, 54 of the half shells 48, 50 in that end of the board which is nearest the board's upper end (the cranium end), in an area where there are no longitudinal ribs 172 on the plate-shaped element 64, an expedient distribution of the blown-in air is achieved, with approx. ⅓ being distributed in the direction of the board's upper end, where the air is led out via the jaw part of the pelt and the slot-shaped openings 94 in the board's front end 14, and with ⅔ of the air distributed in direction of the foot end of the board, where the air here is led out through the open structure of the half shells.

The distension element/pelt board further comprises cf. FIG. 17 spaced, short projecting pins 178 extending in parallel with the longitudinal axis 18, standing out from the pointed end of the respective half shells 48, 50. When introduced into the nose holes of the pelt, the pins serve to effectively hold the nose end of the pelt firmly on the front end of the board.

Furthermore, the area 179 of the pointed end of the half shells 48, 50 between the subtending sides of the pins 178 is bevelled with the object of providing good access for mechanically operative elements for the automatic removal of a dried pelt from the pelt board.

It shall be noted that the individual parts belonging to the system for the drying of the leather side of pelts from furred animals can assume configurations other than those described here and shown in the drawings. However, this does not change the inventive aspect, where by use of a combination of a drying aggregate and a distension element with an open surface structure, a quick, uniform and effective drying of the leather side of the pelt is made possible, whereby "black spots" on the leather side of the pelt are avoided, and which due to the shape of the surface structure makes it possible to secure a pelt in the stretched position solely by means of a fixing-bag, which at least over a limited part of the pelt presses the leather side against the surface structure, whereby the use of damaging clips/staples can be omitted. And furthermore that the pelt board 6 is further configured in such a manner that its half parts are relatively displaceable between a first outer position, where the board has a greater circumference, and a second outer position where the board has a smaller circumference in relation to the first outer position, whereby the removal of the pelt from the board is made considerably easier, the reason being that the reduced circumference results in the pelt coming to sit loosely on the surface of the pelt board, and will hereby be easy to remove together with the fixing-bag.

What is claimed is:

1. Method for the drying a leather side of pelts from furred animals which have a leather side and a fur side, comprising the steps of:

applying a pelt stretched on the outside of pelt board, which is formed of a hollow distension element having surfaces which have an openwork structure and bound a cavity extending lengthwise through the interior of the distension element, with the leather side facing the surfaces of the hollow distension element, and securing the pelt in on the pelt board by the drawing of a holding-bag over at least a part of a lower end of the pelt so as to press the pelt against the board, mounting the pelt board with the pelt thereon in an upstanding position and drying of the leather side of the pelt by replacement of air inside a cavity of the distension element by exchanging the air within the cavity of the hollow distension element by directing a flow of air through the cavity via at least one of an opening in a foot end of the hollow distension element and openings in a protruding top portion of the hollow distension element.

2. Method according to claim 1, where replacement of the air inside the hollow distension element is carried out by placing at least one distension element on a cooperating drying aggregate comprising an encapsulation which has a cavity, at least one first opening for the at least one distension element in an upwardly facing surface thereof, further openings lying in the upwardly facing surface near the respective at least one first opening within an area covered by said foot end of the respective pelt board, so that the further openings connect with the cavity in the respective distension element which extends upwardly from the encapsulation, wherein said flow of air is produced by means of an air replacement arrangement connected to the cavity of the encapsulation, said further openings in said upwardly facing surface and the opening in the foot end of the hollow distension element.

3. System for drying the leather side of pelts from furred animals which have a leather side and a fur side, comprising:

pelt board, which is formed of a hollow distension element having a cavity extending lengthwise therethrough, the outside of which adapted to have a pelt drawn, stretched and secured thereover for drying with the leather side facing towards the surface of the hollow distension element, wherein the hollow distension element has a front end, an open foot end and an outer surface with an openwork structure having a plurality of openings communicating with said cavity of the distension element, wherein the open foot end of the hollow distension element cooperates with a drying aggregate comprising an encapsulation with a cavity connected to an air replacement arrangement, wherein said encapsulation comprises at least an upwardly-facing surface with first openings which cooperate with a lower part of the foot end of the hollow distension element for supporting the distension element on the upwardly-facing surface, and further openings which communicate with the cavity of the distension element via the open foot end, so that the air in the cavity of a distension element placed on the upwardly-facing surface is changed by replacement of the air in the cavity by means of the air replacement arrangement, said further openings in the upwardly facing surface and the open foot end of the hollow distension element.

4. Hollow distension element pelt board for the drying of a pelt placed thereon with a leather side of the pelt stretched and held on an outer surface of the pelt board, wherein the pelt board has a longitudinal axis, a first transverse axis and a second transverse axis, a front end for engagement in a cranium end of the pelt, and a foot end which has at least one opening, wherein the pelt board has at least a first and a second convex outer surface with an open structure and which define a cavity between the convex outer surfaces which taper in the direction of the longitudinal axis from a front end toward the foot end of the pelt board, and wherein the first and second convex outer surfaces of the pelt board are configured in a substantially symmetrical manner around at least two of the said axes, and wherein at least one opening in the foot end is connected to said cavity, and wherein a stubby projecting element is arranged in a substantially transverse manner to the longitudinal axis of the board in the direction of the second transverse axis at said foot end for vertically mounting of the pelt board in an opening in a support surface.

5. Hollow distension element pelt board according to claim 4, the length of the pelt board in relation to the longitudinal axis in the direction of the first transverse axis and the second transverse axis substantially evenly decreases extending from an area of the pelt board near the foot end in a direction toward the front end, wherein the front end is rounded, and wherein the length of the pelt board in directions of the first transverse axis and the second transverse axis is essentially constant.

6. Hollow distension element pelt board for the drying of a pelt placed thereon with a leather side of the pelt stretched and held on an outer surface of the pelt board, wherein the pelt board has a longitudinal axis, a first transverse axis and a second transverse axis, a front end for engagement in a cranium end of the pelt, and a foot end which has at least one opening, wherein the pelt board has at least a first and a second arched surface with an open structure and which define a cavity, and wherein the first and second arched surfaces of the pelt board are configured in a substantially symmetrical manner around at least two of the said axes, and wherein at least one opening in the foot end is connected to said cavity, wherein the first and second arched surfaces have a first grooving which is oriented substantially in the direction of the longitudinal axis.

7. Hollow distension element pelt board according to claim 6, wherein the first and second arched surfaces have a second grooving arranged in a substantially transverse manner in relation to the orientation of the first grooving.

8. Hollow distension element pelt board according to claim 7, wherein the extent of the second transverse grooving is limited to an area nearest the foot end.

9. Hollow distension element pelt board according to claim 7, wherein tops of grooves of the second grooving are aligned, and where parts between two consecutive groove tops, extending from a groove top nearest the foot end towards the front end, is inclined towards a substantially planar part, and where a part between the substantially planar part and a following groove top is essentially vertical.

10. Hollow distension element pelt board for the drying of a pelt placed thereon with a leather side of the pelt stretched and held on an outer surface of the pelt board, wherein the pelt board has a longitudinal axis, a first transverse axis and a second transverse axis, a front end for engagement in a cranium end of the pelt, and a foot end which has at least one opening, wherein the pelt board has at least a first and a second arched surface with an open structure and which define a cavity, and wherein the first and second arched surfaces of the pelt board are configured in a substantially symmetrical manner around at least two of the said axes, and wherein at least one opening in the foot end is connected to said cavity, wherein each of the first and second arched surfaces is formed on a respective one of two similarly-shaped half parts which are joined together by a locking assembly, subtending sides of said half parts defining a first plane which coincides substantially with the first transverse axis, wherein the locking assembly is arranged such that the two half parts are relatively displaceable away from and towards the first plane, between a first outer position in which a slot-shaped opening is formed between the subtending sides of the half parts, and a random position in which said sides contact each other and wherein a forcing means for locking of the half parts in the first outer position is insertable between the half parts.

11. Hollow distension element pelt board according to claim 10, wherein the two similar half parts comprise a first half shell and a second half shell which, in combination, form said cavity which is open at the foot end, and wherein said cavity communicates with said surfaces via perforations or holes of the open structure.

12. Hollow distension element pelt board according to claim 10, wherein the locking assembly is arranged in such a manner that the two half parts are relatively displaceable away from and towards the first plane, between a first outer position in which a slot-shaped opening is formed between the edges of the half parts, and a second outer position in which the subtending sides of the half parts are positioned closer to the first plane.

13. Hollow distension element pelt board according to claim 11, wherein, the subtending sides of the half shells are provided with stiffeners.

14. Hollow distension element pelt board according to claim 13, wherein similarly shaped, laterally-reversed studs project from the stiffeners.

15. Hollow distension element pelt board according to claim 14, wherein the forcing means comprises a displaceable element with wedge-shaped projections which engageable and disengageable from planar sides of the studs, wherein said displaceable element is substantially plate-shaped and is disposed in the first plane between the two half shells, and is displaceable in a longitudinal direction.

16. Hollow distension element pelt board according to claim 15, wherein the subtending sides of the half shells comprise projecting parts which cooperate with holes and recesses in the displaceable element for orientation of and control of the extent of the longitudinal displacement of the displaceable element.

17. Hollow distension element pelt board according to claim 10, wherein the locking assembly comprises cooperating elements projecting from the respective subtending sides of the half parts, the cooperating elements comprising projections and projections with openings for engaging said projections, where geometries of the openings of the projections with openings and the projections are mutually proportioned in such a manner that the projections, after being pressed in to the openings of the projections with openings, are secured in a displaceable manner therein.

18. Hollow distension element pelt board according to claim 10, wherein the forcing means comprises means for displacement of the half parts from a first distended position to a second outer position, and wherein edges of the half parts are brought into contact with each other by displacement of the forcing means into the retracted position.

19. Hollow distension element pelt board according to claim 18, wherein the forcing means comprises a displaceable element with wedge-shaped projections which engageable and disengageable from planar sides of the studs, wherein said displaceable element is substantially plate-shaped and is disposed in the first plane between the two half shells, and is displaceable in a longitudinal direction; wherein tongues are provided on the plate-shaped element, said tongues having sloping wedge surfaces which, from a plane surface nearest free ends of the tongues, decrease in a direction towards starting points of the tongues, said sloping wedge surfaces and plane surfaces cooperating with side surfaces in bridges on the subtending sides of the half parts into which bridges the tongues are introduced.

20. Hollow distension element pelt board according to claim 19, wherein, along a part of the side edges, the plate-shaped element further comprises V-shaped tracks for the engaging of guide pins projecting from the subtending sides of the first half part and the second half part, respectively, so that by displacement of the plate-shaped element said side edges are displaced sideways away from the longitudinal axis to a position where the side edges fill out the slot-shaped opening between the edges of the half parts.

21. Hollow distension element pelt board according to claim 10, wherein the forcing means comprises a stubby projecting element which extends outside the foot end of the pelt board.

22. Hollow distension element pelt board according to claim 21, wherein the stubby projecting element comprises counter-hold surfaces.

23. Hollow distension element pelt board according to claim 10, wherein the arched surfaces have a plurality of slot-shaped openings at a front end thereof.

24. Hollow distension element pelt board according to claim 10, wherein means for securing a nose end of a pelt placed and stretched on the pelt board is provided at the front end thereof.

25. Hollow distension element pelt board according to claim 24, wherein the means for securing the nose end of a pelt stretched on the pelt board comprises spaced, short, projecting parallel pins which extend from a pointed end of the respective half shell parallel with the longitudinal axis thereof.

26. Hollow distension element pelt board according to claim 25, wherein the area of the pointed end of the half shells between subtending sides of the pins is bevelled.

27. Hollow distension element pelt board according to claim 24, wherein the arched surfaces of the pelt board have spaced recesses in an area which extends from near a cranium end and towards an area of the board in which in the length in the direction of the first transverse axis and the second transverse axis essentially constant.

28. Hollow distension element pelt board according to claim 10, wherein the half parts are made of a plastic material selected from the group consisting of polymeric plastic material, fiber-reinforced plastic material, and combinations thereof.

29. Drying aggregate for use with hollow distension element pelt boards for the drying of a pelt placed thereon with a leather side of the pelt stretched and held on an outer surface of the pelt board, the pelt board having a longitudinal axis, a first transverse axis and a second transverse axis, a front end for engagement in a cranium end of the pelt, and a foot end which has at least one opening, a first and a second arched surface with an open structure and which define a cavity and are configured in a substantially symmetrical manner around at least two of the said axes, and at least one opening that is connected to said cavity being provided in the foot end, said drying aggregate comprising:

an encapsulation which defines a cavity, and an air replacement arrangement for changing the air existing in the cavity, said encapsulation comprising at least an upwardly-facing surface with a plurality of first openings and a plurality of substantially U-shaped profile rails extending in parallel under said surface, the profile rails having openings with a geometry and number which correspond to the first openings, said first openings and the openings of the profile rails cooperating, in use, with a projecting element which extends from the foot end of a respective distension element pelt board for the supporting of at least one distension elements pelt board standing upright from the upwardly-facing surface, with the foot end of the pelt board in contact with the upwardly-facing surface, and further openings near the respective first openings at a location which, in use, lies within an area under the foot end of a respective pelt board, so that the further openings are in communication with the cavity in the respective pelt board so that the air in the cavity will be changed by replacement of the air in the cavity by the air replacement arrangement.

30. Drying aggregate according to claim 29, wherein the first openings and the further openings are arranged in parallel rows extending in the upwardly-facing surface, and wherein slots are provided in ribs of the U-shaped profile rails in which displaceable drawplates are disposed parallel with the upwardly-facing surface, said drawplates having through-going cut-outs for engaging the projecting element of a pelt board, and where each through-going cut-out comprises a projection which cooperates with a wedge-shaped, part on the projecting element, said projection being oriented in a substantially transverse manner to the longitudinal axis of the pelt board, and wherein the drawplates are displaceable into a first outer position in which the projections are not in engagement with the wedge-shaped part and a second outer position in which the projections are in engagement with the wedge-shaped part.

31. Drying aggregate according to claim 30, wherein the drawplates comprise parts extending freely through a side of the encapsulation, said parts comprising through-going openings for establishing traction facilities for displacement of the drawplates.

32. Drying aggregate according to claim 29, wherein the encapsulation comprises displaceable elements which cooperate with the counterholding surfaces of a projecting element of the pelt board for displacement of a forcing means of the pelt board for expanding of the pelt board.

33. Drying aggregate according to 29, wherein the encapsulation is mounted on wheels which make it mobile.

34. Drying aggregate according to claim 29, wherein the air replacement arrangement comprises a blower unit integrated with the encapsulation.

35. Drying aggregate according to claim 29, wherein the air replacement arrangement comprises a suction unit integrated with the encapsulation.

* * * * *